US008260621B2

(12) United States Patent
Miseki

(10) Patent No.: US 8,260,621 B2
(45) Date of Patent: Sep. 4, 2012

(54) SPEECH CODING METHOD AND APPARATUS FOR CODING AN INPUT SPEECH SIGNAL BASED ON WHETHER THE INPUT SPEECH SIGNAL IS WIDEBAND OR NARROWBAND

(75) Inventor: Kimio Miseki, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 155 days.

(21) Appl. No.: 12/751,421

(22) Filed: Mar. 31, 2010

(65) Prior Publication Data

US 2010/0250245 A1 Sep. 30, 2010

Related U.S. Application Data

(60) Division of application No. 11/240,495, filed on Oct. 3, 2005, now Pat. No. 7,788,105, which is a continuation of application No. PCT/JP2004/004913, filed on Apr. 5, 2004.

(30) Foreign Application Priority Data

Apr. 4, 2003 (JP) ..... 2003-101422
Mar. 12, 2004 (JP) ..... 2004-071740

(51) Int. Cl.
*G10L 19/00* (2006.01)
*G10L 19/10* (2006.01)

(52) U.S. Cl. ..... 704/500; 704/219; 704/222; 704/223

(58) Field of Classification Search ..... None
See application file for complete search history.

(56) References Cited

U.S. PATENT DOCUMENTS 4,330,689 A 5/1982 Kang et al.
4,932,061 A 6/1990 Kroon et al.
5,323,396 A 6/1994 Lokhoff
5,444,816 A 8/1995 Adoul et al.
5,455,888 A 10/1995 Iyengar et al.

(Continued)

FOREIGN PATENT DOCUMENTS

JP 61-043796 3/1986

(Continued)

OTHER PUBLICATIONS

Notice of Reasons for Rejection mailed Sep. 8, 2009, from the Japanese Patent Office for counterpart Japanese Patent Application No. 2003-101422 (4 pages).

(Continued)

*Primary Examiner* — Talivaldis Ivars Smits
(74) *Attorney, Agent, or Firm* — Finnegan, Henderson, Farabow, Garrett & Dunner, L.L.P.

(57) ABSTRACT

A wideband speech coding apparatus comprises a wideband speech coding unit configured to code an input speech signal at a bit rate which is set in advance in accordance with a wideband speech signal. The apparatus further comprises an identification unit configured to identify whether the input speech signal is a wideband speech signal or a narrowband speech signal. The apparatus further comprises a control unit configured to cause the wideband speech coding unit to code the input speech signal, when the identification unit identifies that the input speech signal is the wideband speech signal, and to cause the wideband speech coding unit to raise the bit rate to code the input speech signal, when the identification unit identifies that the input speech signal is the narrowband speech signal. The apparatus further comprises an output unit to output the input speech signal coded by the wideband speech coding unit.

12 Claims, 20 Drawing Sheets

U.S. PATENT DOCUMENTS

| | | | |
|---|---|---|---|
| 5,699,482 | A | 12/1997 | Adoul et al. |
| 5,701,392 | A | 12/1997 | Adoul et al. |
| 5,752,223 | A | 5/1998 | Aoyagi et al. |
| 5,754,976 | A | 5/1998 | Adoul et al. |
| 5,933,803 | A | 8/1999 | Ojala |
| 6,067,517 | A | 5/2000 | Bahl et al. |
| 6,260,009 | B1 | 7/2001 | Dejaco |
| 6,385,576 | B2 | 5/2002 | Amada et al. |
| 6,424,941 | B1 | 7/2002 | Yu |
| 6,480,822 | B2 | 11/2002 | Thyssen |
| 6,600,741 | B1 | 7/2003 | Chrin et al. |
| 6,662,154 | B2 | 12/2003 | Mittal et al. |
| 6,782,367 | B2 | 8/2004 | Vainio et al. |
| 6,847,929 | B2 | 1/2005 | Bernard |
| 6,961,698 | B1 | 11/2005 | Gao et al. |
| 6,988,066 | B2 | 1/2006 | Malah |
| 7,072,366 | B2 | 7/2006 | Parkkinen et al. |
| 7,136,810 | B2 | 11/2006 | Paksoy et al. |
| 7,315,815 | B1 | 1/2008 | Gersho et al. |
| 7,343,282 | B2 | 3/2008 | Kirla et al. |
| 2002/0193988 | A1 | 12/2002 | Chennoukh et al. |
| 2003/0093264 | A1 | 5/2003 | Miyasaka et al. |
| 2004/0114750 | A1 | 6/2004 | LeBlanc et al. |
| 2004/0117176 | A1 | 6/2004 | Kandhadai et al. |
| 2004/0230432 | A1 | 11/2004 | Liu et al. |
| 2004/0243400 | A1 | 12/2004 | Klinke |
| 2004/0254786 | A1 | 12/2004 | Kirla et al. |
| 2005/0177364 | A1 | 8/2005 | Jelinek |
| 2005/0267746 | A1 | 12/2005 | Jelinek et al. |

FOREIGN PATENT DOCUMENTS

| | | |
|---|---|---|
| JP | 05-037674 | 2/1993 |
| JP | 07-212320 | 8/1995 |
| JP | 9-127985 | 5/1997 |
| JP | 09-127994 | 5/1997 |
| JP | 11-202900 | 7/1999 |
| JP | 11-259099 | 9/1999 |
| JP | 2000-181494 | 6/2000 |
| JP | 2000-206995 | 7/2000 |
| JP | 2000-305599 | 11/2000 |
| JP | 2001-215999 | 8/2001 |
| JP | 2001-318698 | 11/2001 |
| JP | 2001-337700 | 12/2001 |
| JP | 2002-140098 | 5/2002 |
| JP | 2003-140696 | 5/2003 |
| WO | WO 02/43053 | 5/2002 |

OTHER PUBLICATIONS

Notification of Reasons for Rejection mailed May 15, 2007, from Japanese Patent Office in Japanese Patent Application No. 2004-071740.

3rd Generation, Partnership Project 2, "Source-Controlled Variable-Rate Multimode Wideband Speech Codec (VMR-WB); Service Options 62 an xx for Wideband Spread Spectrum Communication Systems," 3GPP2 C.P0052-0, Version 1, 6 sheets, Mar. 15, 2004.

ITU-T, Telecommunication Standardization Sector of ITU, G.722.2, "Series G: Transmission of Systems and Media, Digital Systems and Networks," 2 sheets, (Jan. 2002).

Ahmadi, S., "Updated Stage One Requirements for CDMA2000 Wideband Speech Coder," 3rd Generation Partnership Project 2, 3GPP2-C11-20021021-020R1, pp. 1-11, (Oct. 21, 2002).

Yatsuzuka, "Highly Sensitive Speech Detector and High-Speed Voiceband Data Discriminator in DSI-ADPCM Systems", IEEE Trans. on Commun., vol. 30, No. 4, 1982, pp. 739-750.

Nomura et al., "A Bit rate and Bandwidth Scalable CELP Coder," Proc. ICASSP-98, May 1998, pp. 341-344.

Pujalte et al., "Wideband ACELP at 16 kb/s with Multi-band Excitation." Proceedings EUROSPEECH '01. European Conference on Speech Communication and Technology, Sep. 2001.

Makinen et al., "The Effect of Source Based Rate Adaptation Extension in AMR-WB Speech Codec". In: IEEE Workshop on Speech Coding. Tsukuba, Ibaraki, Japan, Oct. 2002, pp. 153-155.

Schroeder et al., "Code-Excited Linear Prediction (CELP): High-Quality Speech at Very Low Bit Rates," Proc. ICASSP-85, IEEE 1985, pp. 937-940.

International Preliminary Report on Patentability ("Report") mailed Mar. 9, 2006, from the International Bureau in PCT application No. PCT/JP2004/004913.

Notice of Reasons for Rejection, issued by Japanese Patent Office, mailed Feb. 21, 2012, in counterpart Japanese patent application No. 2009-256477, 4 pages.

27c

| Track | Pulse | Candidate of pulse position |
|---|---|---|
| 1 | $i_0$ | 0, 4, 8, 12, 16, 20, 28, 32, 36, 40, 44, 48, 52, 56, 60 |
| 2 | $i_1$ | 1, 5, 9, 13, 17, 21, 25, 29, 33, 37, 41, 45, 49, 53, 57, 61 |
| 3 | $i_2$ | 2, 6, 10, 14, 18, 22, 26, 30, 34, 38, 42, 46, 50, 54, 58, 62 |
| 4 | $i_3$ | 3, 7, 11, 15, 19, 23, 27, 31, 35, 39, 43, 47, 51, 55, 59, 63 |

FIG. 4

27d

| Track | Pulse | Candidate of pulse position |
|---|---|---|
| 1 | $i_0$ | 0, 8, 16, 24, 32, 40, 48, 56 |
| 2 | $i_1$ | 2, 10, 18, 26, 34, 42, 50, 58 |
| 3 | $i_2$ | 4, 12, 20, 28, 36, 44, 52, 60 |
| 4 | $i_3$ | 6, 14, 22, 30, 38, 46, 54, 62 |
| 5 | $i_4$ | 0, 10, 20, 30, 32, 42, 52, 62 |

FIG. 5

| Track | Pulse | Candidate of pulse position |
|---|---|---|
| 1 | $i_0$ | 1, 9, 17, 25, 33, 41, 49, 57 |
| 2 | $i_1$ | 3, 11, 19, 27, 35, 43, 51, 59 |
| 3 | $i_2$ | 5, 13, 21, 29, 37, 45, 53, 61 |
| 4 | $i_3$ | 7, 15, 23, 31, 39, 47, 55, 63 |
| 5 | $i_4$ | 1, 11, 21, 31, 33, 43, 53, 63 |

SPEECH CODING METHOD AND APPARATUS FOR CODING AN INPUT SPEECH SIGNAL BASED ON WHETHER THE INPUT SPEECH SIGNAL IS WIDEBAND OR NARROWBAND

CROSS REFERENCE TO RELATED APPLICATIONS

This is a divisional of and claims the benefit of priority of U.S. application Ser. No. 11/240,495, filed Oct. 3, 2005 now U.S. Pat. No. 7,788,105, which is a Continuation Application of PCT Application No. PCT/JP2004/004913, filed Apr. 5, 2004, which is based upon and claims the benefit of priority from prior Japanese Patent Applications No. 2003-101422, filed Apr. 4, 2003; and No. 2004-071740, filed Mar. 12, 2004, the entire contents of all of which are incorporated herein by reference.

BACKGROUND OF THE INVENTION

1. Field of the Invention

The present invention relates to a method and an apparatus for high-quality coding or decoding not only of a wideband speech signal but also of a narrowband speech signal.

2. Description of the Related Art

In digital transmission of speech signals for use in conventional cellular phone communication or voice over internet protocol (VoIP) communication, the speech signals have heretofore been sampled at a sampling frequency (or sampling rate) of 8 kHz, and coded and transmitted by a coding system adapted to the sampling rate. As known from the sampling theorem, signals sampled at a sampling rate of 8 kHz do not include frequencies which are more than 4 kHz, which corresponds to half the sampling frequency. In this manner in the field of speech coding, a speech signal in which frequencies of 4 kHz or more are not included is referred to as narrowband speech (or telephone band speech).

A system adapted to narrowband speech is used in coding/decoding the narrowband speech. For example, G.729 which is an international standard in ITU-T, or an adaptive multi-rate-narrowband (AMR-NB) which is a 3GPP standard is a speech coding/decoding system for narrowband, and the sampling rate for the input speech signal is defined as 8 kHz.

On the other hand, by use of a speech signal having a higher sampling rate of about 16 kHz, it is possible to represent speech including a wide frequency band of about 50 Hz to 7 kHz. In the field of speech coding, a speech signal represented using a sampling frequency which is sufficiently higher than 8 kHz in this manner (the frequency is usually about 16 kHz, but there is also a sampling frequency of about 12.8 kHz or 16 kHz or more depending on the situation) is referred to as a wideband speech. A wideband speech coding system which is different from a usual narrowband speech coding system and which is adapted to wideband speech is used in order to code this wideband speech.

For example, G.722.2 which is an international standard in ITU-T is an coding/decoding system for wideband speech, and the sampling frequency of the speech signal input into a coder and the sampling frequency of the speech signal output from a decoder are both defined as 16 kHz. The wideband speech coding system described in G.722.2 is referred to as the Adaptive Multi-rate Wideband (AMR-WB) system, and its objective is to encode/decode the wideband speech signal having a sampling frequency of 16 kHz with high quality. Nine bit rates are usable in AMR-WB. In general, the quality of the speech produced by performing the coding and decoding at a high bit rate is comparatively good, but the speech produced by performing the coding and decoding at a low bit rate has a large coding distortion, and speech quality therefore tends to deteriorate.

In this wideband speech coding system described in ITU-T Recommendation G.722.2 (AMR-WB) in this manner, the coding and the decoding are performed assuming that a wideband speech signal having a bandwidth of 50 Hz to 7 kHz is handled. Therefore, the sampling frequencies of the input signal of the coding and the output signal of the decoding are set to 16 kHz.

However, in a system in which a narrowband speech communication system to handle a speech signal that does not have a frequency of 4 kHz or more as in a usual telephone speech coexists with the wideband speech communication system, there occurs a case where the narrowband speech signal is handled in the wideband speech communication system. In this case, coded data produced by coding the narrowband speech signal by the wideband speech coding is decoded by the wideband speech decoding corresponding to the wideband speech coding. In this case, the speech signal to be decoded is decoded in the same process as that of a usual wideband speech signal.

Therefore, although the sampling frequency is for the wideband signal, it is expected that the narrowband speech signal seldom having frequency components of 4 kHz or more even when decoded is reconstructed, because the narrowband speech signal that does not have the frequency of 4 kHz or more is originally encoded. Provisionally, when there is distortion by the coding, or a band expansion process or the like in a decoding process, even the narrowband speech signal has a certain degree of frequency components of 4 kHz or more when encoded/decoded.

Thus, when transmitting the narrowband speech signal that does not have the frequency of 4 kHz or more in the conventional wideband coding system, the speech is encoded by the wideband speech coding on the transmission side and decoded using usual wideband speech decoding also on the reception side. In the conventional system represented by AMR-WB, the coding and the decoding are specialized for the wideband speech signal.

Accordingly, even the coded data which produces the narrowband speech signal seldom having the frequency of 4 kHz or more is subjected to the decoding specialized for the wideband speech signal, and therefore there is a problem that the quality of the produced narrowband speech signal deteriorates. This tendency is especially remarkable at the low bit rate at which high compression efficiency is required.

Therefore, for example, when using wideband speech coding/decoding with respect to a narrowband speech signal whose band is limited by the use of, for example, a narrowband communication path/storage system, or narrowband codec, there is a problem that the speech quality is remarkably degraded at the low bit rate of around 6 to 10 kbit/sec as compared with the use of the narrowband speech coding/decoding. This is not limited to a narrowband speech signal, and a similar problem lies in handling a speech signal having very little frequency of more than 4 kHz, and there has heretofore been a problem that high-quality speech cannot be provided at a low bit rate in conventional wideband speech decoding.

Moreover, in the conventional AMR-WB system, a wideband speech decoding unit comprises a lower-band section (to produce the lower-band speech signal less than or equal to about 6 kHz), and a higher-band section (to produce the higher band speech signal about 6 kHz to 7 kHz). The lower-band section is a CELP-based speech coding system, and a higher band speech signal produced in the higher-band section is constantly added to the lower-band speech signal produced by decoding in the lower-band section to produce an output signal of the wideband speech decoding unit.

Thus, the decoding unit of the AMR-WB system is specialized for wideband speech. Therefore, even when decoded data to produce narrowband speech is input, there is a problem that an unnecessary higher-band signal produced by the higher-band section is added to a speech output from the speech decoding unit.

Various methods have heretofore been proposed as a method for improving efficiency of the coding/decoding corresponding to the low bit rate. For example, in Jpn. Pat. Appln. KOKAI Publication No. 2001-318698 (pages 2 to 4, FIG. 1), a technique is described in which a plurality of sets of positions of pulses expressing excitation signals are prepared, a set which minimizes a distortion with respect to the input speech signal is selected, and distinction information is transmitted to the reception side to thereby deal with the lowering of the bit rate.

Moreover, in Jpn. Pat. Appln. KOKAI Publication No. 11-259099 (pages 2, 5, 6, FIG. 1), a method is described in which a structure of a coding and decoding apparatus is switched by identification of speech/non-speech of the input signal. In this method, a structure in which a function block of a part of a coder or a decoder is optimized for processing the speech signal, and a structure optimized for processing a non-speech signal are disposed. Moreover, these structures are switched based on identification information of speech/non-speech.

However, in the technique described in the Jpn. Pat. Appln. KOKAI Publication No. 2001-318698, the distortion needs to be calculated with respect to each set of the possessed pulse positions. Therefore, there is a problem that the calculation amount required for selecting the set of pulse positions becomes enormous.

Moreover, in any of the above-described methods, a problem of mismatch between the speech coding system and the bandwidth of the input signal is not considered. Therefore, degradation of the speech quality caused in a case where the coded data of narrowband speech encoded at the low bit rate in the wideband signal as described above is decoded by the wideband speech decoding cannot be improved.

BRIEF SUMMARY OF THE INVENTION

An object of the present invention is to provide a coding or decoding method and an apparatus capable of obtaining a satisfactory speech quality with respect to not only a wideband speech signal but also a narrowband speech signal.

To achieve the above object, an aspect of the present invention is a wideband speech coding method comprising identifying whether an input speech signal is a narrowband signal or a wideband signal, and coding the input speech signal by controlling a predetermined parameter of a wideband speech coding process based on the identification result.

BRIEF DESCRIPTION OF THE SEVERAL VIEWS OF THE DRAWING

FIG. 4 is a diagram showing pulse position candidates of integer sample positions shown in FIG. 3;

FIG. 5 is a diagram showing the pulse position candidates of even-number sample positions shown in FIG. 3;

DETAILED DESCRIPTION OF THE INVENTION

First Embodiment

Figure 1:
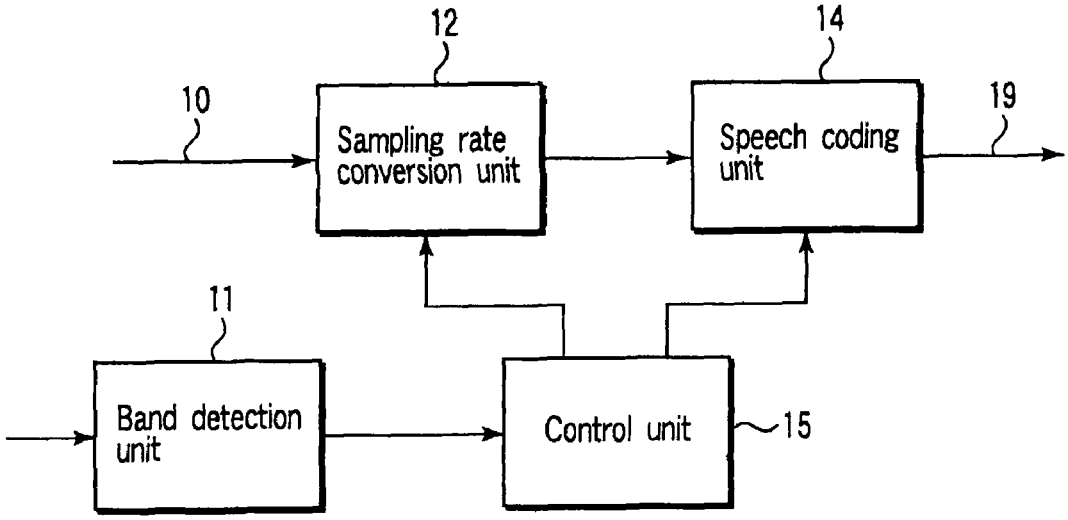
FIG. 1 is a block diagram showing a constitution of a wideband speech coding apparatus according to a first embodiment of the present invention.

FIG. 1 is a block diagram showing a constitution of a wideband speech coding apparatus according to a first embodiment of the present invention. This apparatus comprises a band detection unit 11, a sampling rate conversion unit 12, a speech coding unit 14, and a control unit 15 which controls the whole apparatus. Moreover, the apparatus codes an input speech signal 10, and outputs a coded output code 19.

The band detection unit 11 detects a sampling rate of the input speech signal 10, and notifies the control unit 15 of the detected sampling rate. As a method of detecting the sampling rate, any of the following methods is used:

(1) a method of inputting and detecting sampling rate information of the input speech signal 10 from the outside;

(2) a method of acquiring and detecting attribute information (header information of a file, etc.) of the input speech signal 10; and (3) a method of acquiring identification information of a codec in which the input speech signal 10 is produced, and detecting a sampling rate of the input speech signal depending on whether the codec is a narrowband codec or a wideband codec.

Figure 10:
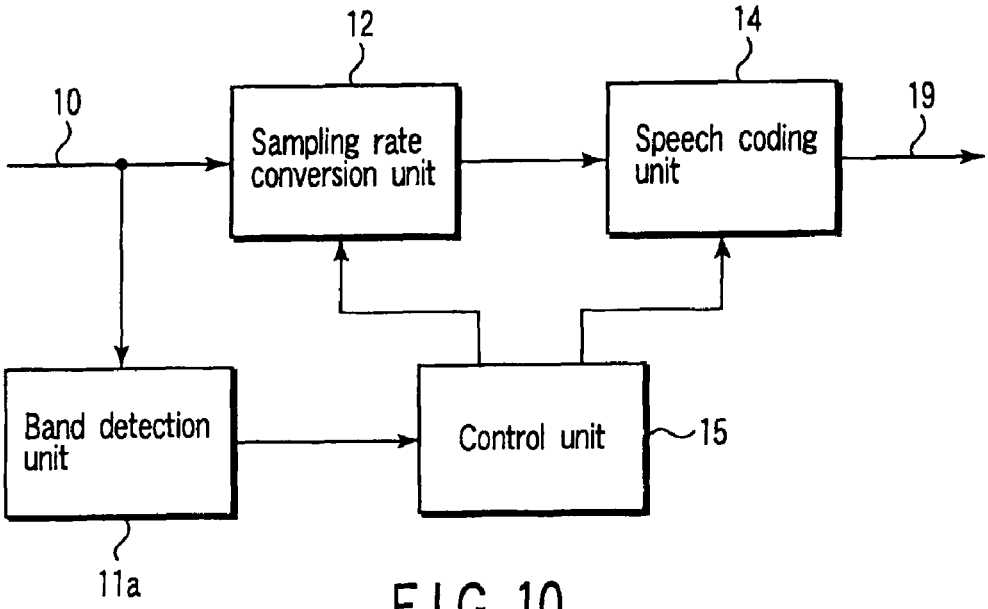
FIG. 10 is a block diagram showing another constitution example of the wideband speech coding apparatus according to the present invention.

It is to be noted that the method of detecting the sampling rate is not limited to these methods. For example, as shown in FIG. 10, it is possible to acquire information which identifies sampling rate information or a wideband/narrowband signal from the input speech signal 10 in a band detection unit 11*a*. This method is usable in a case where sampling rate information, information which identifies wideband/narrowband, attribute information of the input speech signal, identification information of the codec which has produced the input speech signal 10, or the like is embedded.

As the embedding method, for example, a method of burying the information, for example, in a least significant bit of PCM of input speech signal series is considered. In this case, it is possible to embed the sampling rate information, information which identifies wideband/narrowband, attribute information of the input speech signal, identification information of the codec which has produced the input speech signal 10 or the like without influencing significant bits of PCM, that is, without influencing a speech quality of the input speech signal.

Thus, various embodiments are considered as the band detection unit. In short, needless to say, any constitution may be used as long as the constitution is capable of identifying the sampling rate information, or is capable of identifying the wideband/narrowband, or is capable of identifying codec. As to the sampling rate information or the identification information of the wideband/narrowband or the identification information of the codec, representative information may be used.

The sampling rate conversion unit 12 converts the input speech signal 10 into a speech signal having a predetermined sampling rate, and transmits the converted signal having the predetermined sampling rate to the speech coding unit 14. For example, when an 8 kHz sampling signal is input, a sampled-up 16 kHz sampling signal is produced and output using an interpolation filter. When the 16 kHz sampling signal is input, the sampling rate is output without being converted.

It is to be noted that a constitution of the sampling rate conversion unit 12 is not limited to this. For example, the method of converting the sampling rate is not limited to the interpolation filter, and can be realized by the use of frequency conversion methods such as FFT, DFT, and MDCT.

For example, when the sampling-up is performed, first the input signal is converted into a frequency conversion region by FFT, DFT, MDCT or the like. Moreover, zero data is added to data of the frequency region obtained by the conversion on the high-band side to thereby expand the data. It is to be noted that it is also possible to assume virtual addition. Next, a sampled-up input signal is obtained by inverse conversion of the expanded data.

In this constitution, high-speed calculation such as FFT or MDCT is usable, and it is therefore possible to convert the sampling rate with less calculation as compared with the use of the interpolation filter.

The speech coding unit 14 receives the signal sampled at 16 kHz from the sampling rate conversion unit 12. Moreover, the unit codes the received signal, and outputs the coded signal 19.

As a speech coding system used by the speech coding unit 14, a code excited linear prediction (CELP) system will be described as an example, but the speech coding system is not limited to this. The CELP system is described, for example, in M. R. Schroeder and B. S. Atal: "Code-Excited Linear Prediction (CELP): High-quality Speech at Very Low Bit Rates", Proc. ICASSP-85, pp. 937 to 940, 1985" in detail.

Figure 2:
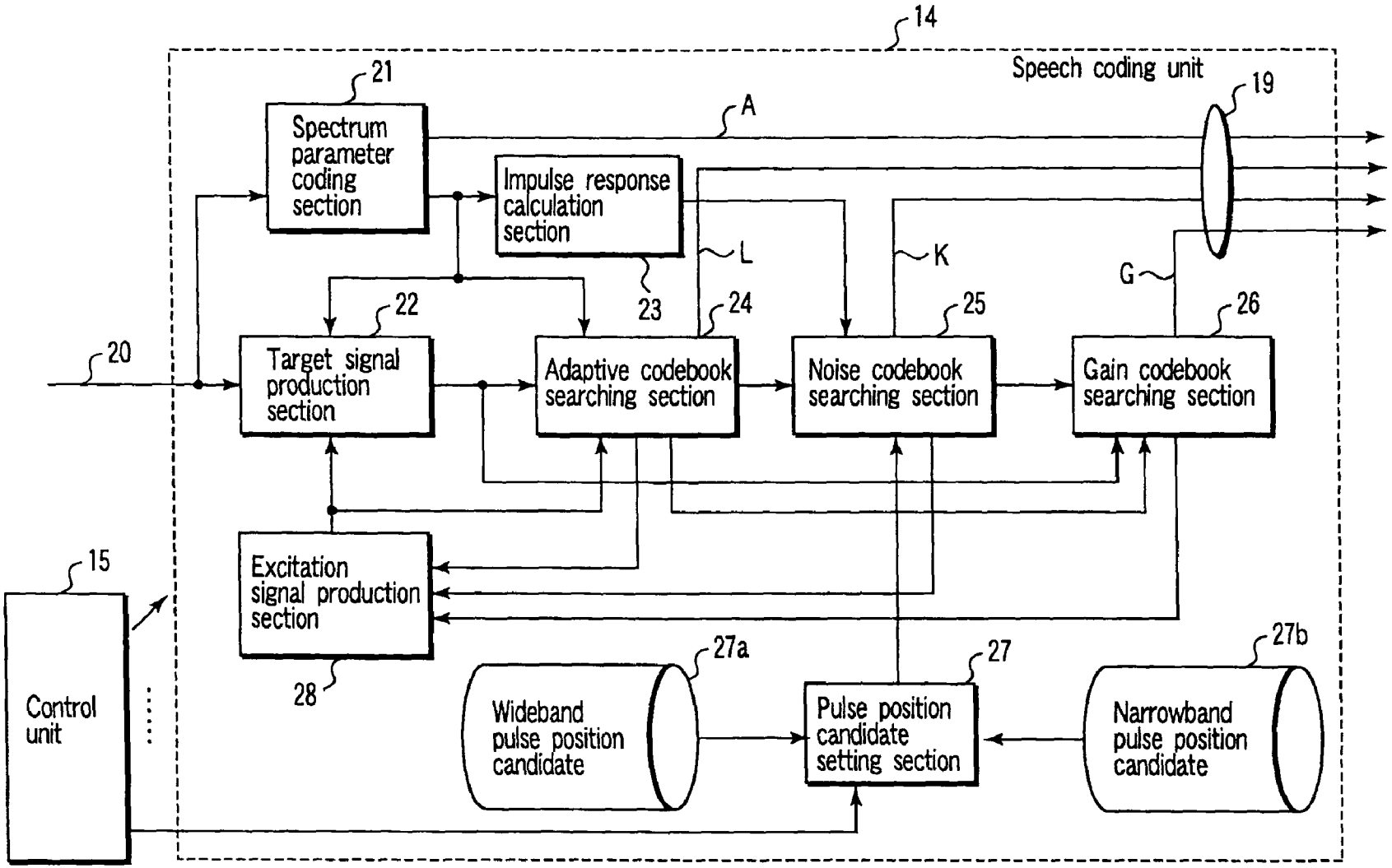
FIG. 2 is a block diagram showing a constitution of a wideband speech coding unit of the wideband speech coding apparatus shown in FIG. 1.

FIG. 2 is a block diagram showing a constitution of the speech coding unit 14. The speech coding unit 14 comprises a spectrum parameter coding section 21, a target signal production section 22, an impulse response calculation section 23, an adaptive codebook searching section 24, a noise codebook searching section 25, a gain codebook searching section 26, a pulse position candidate setting section 27, a wideband pulse position candidate 27*a*, a narrowband pulse position candidate 27*b*, and an excitation signal production section 28.

Next, an operation of the wideband speech coding apparatus constituted as described above according to the first embodiment of the present invention will be described. The speech coding unit 14 is a device which codes an input speech signal 20 and which outputs the coded code 19, and operates as follows.

The spectrum parameter coding section 21 analyzes the input speech signal 20 to thereby extract spectrum parameters. Next, a spectrum parameter codebook stored beforehand in the spectrum parameter coding section 21 is searched using the extracted spectrum parameters. Moreover, an index of the codebook capable of more satisfactorily representing spectrum envelope of the input speech signal is selected, and the selected index is output as a spectrum parameter code (A). The spectrum parameter code (A) is a part of the output code 19.

Moreover, the spectrum parameter coding section 21 outputs non-quantized LPC coefficients and quantized LPC coefficients corresponding to the extracted spectrum parameters. It is to be noted that for simplicity of the description, the non-quantized LPC coefficients and the quantized LPC coefficients will be hereinafter referred to as spectrum parameters.

In the CELP system described herein, the line spectrum pair (LSP) parameter is used as the spectrum parameter for use in coding the spectrum envelope. However, the system is not limited to this, and other parameters such as the linear predictive, coding coefficient, the K parameter, and the ISF parameter for use in G.722.2 may be used as long as the parameters are capable of representing the spectrum envelope.

Into the target signal production section 22, the input speech signal 20, the spectrum parameters output from the spectrum parameter coding section 21, and a excitation signal from the excitation signal production section 28. The target signal production section 22 calculates a target signal X(n) using the respective input signals. As the target signal, a signal obtained by synthesizing an ideal excitation signal from which the influence of past coding is removed with a perceptual weighted synthesis filter is used, but the signal is not limited to this. It is known that the perceptual weighted synthesis filter can be realized using the spectrum parameters.

The impulse response calculation section 23 obtains an impulse response h(n) from the spectrum parameters output from the spectrum parameter coding section 21, and outputs the response. This impulse response can be typically calculated using an perceptual weighted synthesis filter H(z) in which a synthesis filter using the LPC coefficients is combined with a perceptual weighting filter and which has the following characteristic.

$$H(z) = \frac{1}{A_q(z)} W(z) = \frac{1}{A_q(z)} \frac{A(z/\gamma_1)}{A(z/\gamma_2)} \tag{1}$$

It is to be noted that means for calculating the impulse response is not limited to the use of the perceptual weighted synthesis filter H(z).

Here, 1/Aq(z) represents a synthesis filter comprising the following quantized LPC coefficient:

$$\hat{\alpha}_i \tag{2}$$

and is defined as follows:

$$A_q(z) = 1 - \sum_{i=1}^{p} \hat{\alpha}_i z^{-1}. \tag{3}$$

On the other hand, W(z) is an perceptual weighting filter, and comprises the following non-quantized LPC coefficient:

$$\alpha_i \tag{4}$$

and the following results:

$$A(z/\gamma) = 1 - \sum_{i=1}^{p} \alpha_i \gamma^i z^{-1} \tag{5}$$

$$0 < \gamma_2 < \gamma_1 < 1$$

where p is a degree of the LPC. It is known that p=about 16 to 20 is used in the wideband speech coding in which the speech signal having a bandwidth of 0 to about 7 kHz is assumed.

Into the adaptive codebook searching section 24, the spectrum parameters output from the spectrum parameter coding section 21 and the target signal X(n) output from the target signal production section 22 are input. The adaptive codebook searching section 24 extracts a pitch period included in the speech signal from each input signal and an adaptive codebook stored in the adaptive codebook searching section 24. Moreover, an index corresponding to the extracted pitch period is obtained by a coding process, and an adaptive code (L) is output. The adaptive code (L) constitutes a part of the output code 19.

It is to be noted that the excitation signal produced in the excitation signal production section 28 is input into the adaptive codebook searching section 24 before searching the adaptive codebook. The adaptive codebook searching section 24 has a structure to update the adaptive codebook with the input excitation signal. The past excitation signal is stored in the adaptive codebook.

Moreover, the adaptive codebook searching section 24 searches an adaptive code vector corresponding to the pitch period from the adaptive codebook to output the vector to the excitation signal production section 28. Furthermore, the section produces an perceptual weighted synthesized adaptive code vector using the adaptive code vector and the perceptual weighted synthesis filter, and outputs the produced adaptive code vector to the gain codebook searching section 26. Furthermore, the section subtracts a contributing signal component of the adaptive codebook from the target signal X(n) to thereby produce a second target signal X2(*n*) (hereinafter referred to as the target vector X2), and outputs the produced target vector X2 to the noise codebook searching section 25.

The pulse position candidate setting section 27 designates the position of the pulse searched by the noise codebook searching section 25 based on a notice from the control unit 15. The pulse position candidate setting section 27 receives the notice indicating whether the sampling rate of the input speech signal is 16 kHz or 8 kHz (or whether the input signal is a wideband signal or a narrowband signal) from the control unit 15. Subsequently, the section selects either the wideband pulse position candidate 27*a* or the narrowband pulse position candidate 27*b* in response to the received notice, and outputs the selected pulse position candidate.

For example, on receiving the notice indicating that the sampling rate of the input speech signal is 16 kHz, the pulse position candidate setting section 27 selects the wideband pulse position candidate 27*a*. On receiving the notice indicating that the sampling rate of the input speech signal is 8 kHz, the section selects the narrowband pulse position candidate 27*b*.

That is, when the sampling rate of the input speech signal is 8 kHz, unlike a usual wideband speech coding process, an operation of the speech coding unit 14 is controlled in such a manner as to search the noise codebook searching section 25 for the exceptional narrowband pulse position candidate 27*b*.

In the conventional wideband speech coding method, the only sampling rate of 16 kHz is assumed as the input speech signal. Therefore, when the input speech signal before coded is a signal having only narrowband information of the sampling rate of 8 kHz, and when the signal is coded, an only method is to sample up the input signal having the sampling rate of 8 kHz in to speech signal having the sampling rate of 16 kHz to code this as a usual wideband speech signal.

Moreover, in the conventional wideband speech coding apparatus, the position candidate of the pulse for representing the excitation signal is prepared in a position of a high sampling rate corresponding to the wideband signal. In this case, when the coding bit rate is, for example, 10 kbit/sec or less, many bits cannot be assigned to the pulse for representing the excitation signal. Especially because the bit is inefficiently used in the pulse position, it becomes difficult to put the pulse for sufficiently representing the excitation signal. As a result, the quality of the coded and reproduced speech signal is easily degraded.

On the other hand, even when the sampling rate of the input speech signal is converted into a sampling rate of 16 kHz from that of 8 kHz, and input into the speech coding unit 14, the wideband speech coding apparatus in the present embodiment has a function of identifying that the input speech signal is the wideband signal or the narrowband signal before the coding. Therefore, the speech coding unit 14 can be adapted to either of the wideband/narrowband using this identification result.

In this case, when the input speech signal is a narrowband signal, the candidate of the pulse position for representing the excitation signal has a sampling rate lowered, for example, to 8 kHz. Therefore, a disadvantage that the bit is used even in the candidate of the pulse position having an unnecessarily fine resolution can be prevented.

Moreover, the bit which remained by the ability appropriately reducing the resolution of the candidate of the pulse position can be used for other information. For example, the number of pulses can be increased, and accordingly the excitation signal can be further efficiently represented. Therefore, there is an effect that the input speech signal having a sampling rate of 8 kHz can be coded with a higher quality even at a low bit rate of about 10 to 6 kbit/sec.

Figure 3:
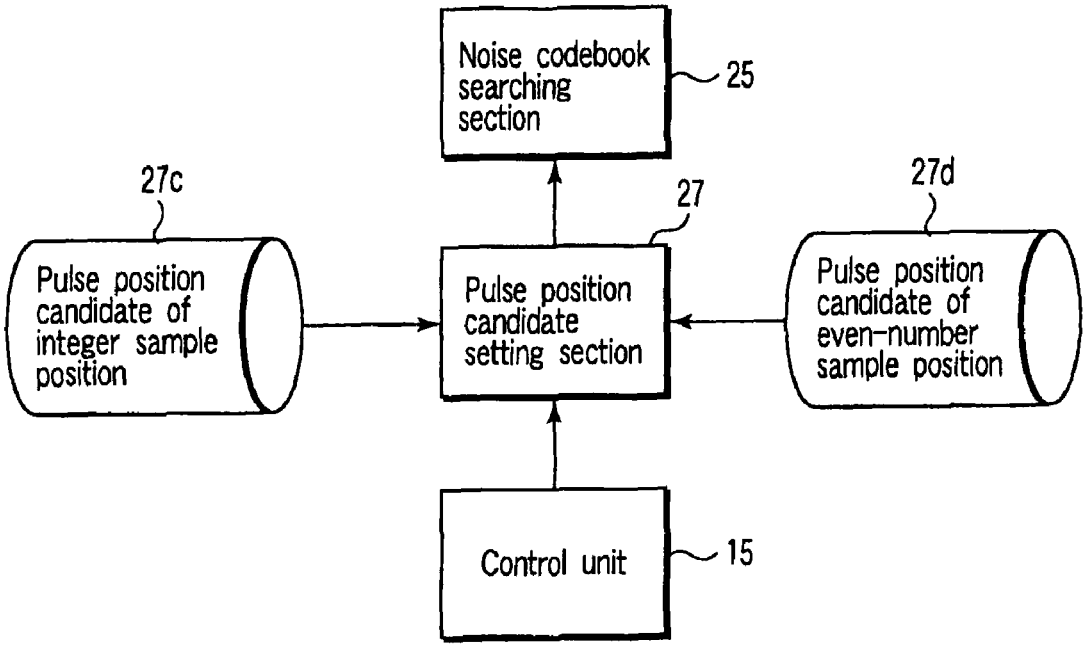
FIG. 3 is a diagram showing a first example of a pulse position candidate setting section of the speech coding unit shown in FIG. 2 and a pulse position candidate.

FIG. 3 shows a constitution in a case where a pulse position candidate 27*c* in an integer sample position is used as the wideband pulse position candidate 27*a* and, on the other hand, a pulse position candidate 27*d* of an even-number sample position is used as the narrowband pulse position candidate 27*b*.

FIG. 4 shows an example of the pulse position candidate 27*c* of the integer sample position in a case where an algebraic codebook is used. Here, the excitation signal is represented by four pulses, and each pulse has an amplitude of "+1" to "−1". An interval for coding the excitation signal is referred to as a sub-frame. Here, a sub-frame length is 64 samples, and each pulse is selected from sample positions of 0 to 63 in the sub-frame.

In the algebraic codebook shown in FIG. 4, the integer sample position of 0 to 63 in the sub-frame is divided into four tracks. Each track includes one pulse only. For example, pulse i0 is selected from one position among candidates {0, 4, 8, 12, 16, 20, 24, 28, 32 36, 40, 44, 48, 52, 56, 60} of the pulse positions included in track 1. In the coding of the pulse per track, four bits are required for 16 pulse position candidates, one bit is required in the pulse amplitude, and therefore (4+1)×4=20 bits are required for four pulses.

It is to be noted that the constitution of the algebraic codebook shown in FIG. 4 is one example, and the present invention is not limited to this. In short, four pulses are selected from the candidates of the integer sample position in the sub-frame.

FIG. 5 shows the pulse position candidate 27*d* of the even-number sample position. Each pulse is selected from the pulse position candidates disposed only in the even-number sample positions among the sample positions of 0 to 63 in the sub-frame. Provisionally, even when several candidates of odd-number sample position are mixed besides the even-number sample positions as the pulse position candidates, essentiality is not impaired.

In the pulse position candidate 27*d* of the even-number sample position, the excitation signal is represented by five pulses, and each pulse has an amplitude of +1 or −1. In the algebraic codebook of FIG. 5, the pulse position candidates capable of putting each pulse are disposed only in the even-number sample positions among the sample positions of 0 to 63 in the sub-frame.

Moreover, the even-number sample position is divided into five tracks in the sub-frame. Each track includes one pulse only. For example, pulse i0 is selected from one position among candidates {0, 8, 16, 24, 32, 40, 48, 56} of the pulse positions included in track 1.

In the pulse position candidate 27*d* of the even-number sample position, three bits are given to eight types of pulse position candidates in coding the pulses, and one bit is given to the pulse amplitude per track. In this case, when 20 bits are given, it is possible to put five pulses. That is, (3+1)×5=20 bits.

It is to be noted that the constitution of the pulse position candidate 27*d* of the even-number sample position is only one example, and various constitutions can be considered with respect to the track. In short, the pulse for the narrowband is selected from the position candidate comprising the even-number sample position in the sub-frame.

Figure 6:
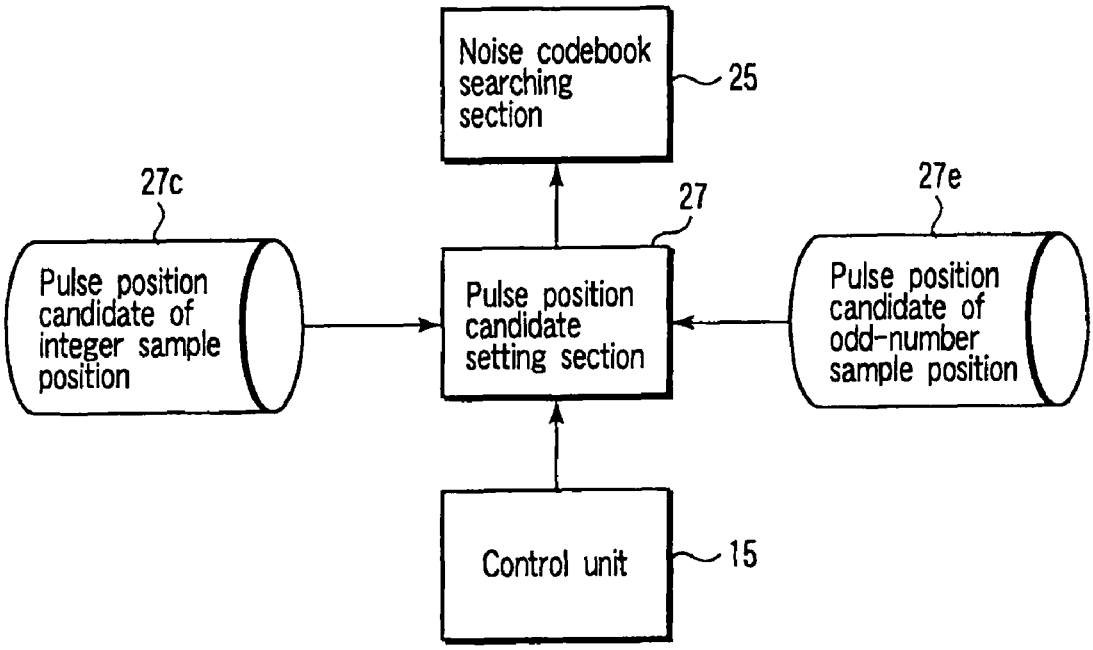
FIG. 6 is a diagram showing a second example of the pulse position candidate setting section of the speech coding unit shown in FIG. 2 and the pulse position candidates.

FIG. 6 shows a constitution in a case where the pulse position candidate 27*c* of the integer sample position is used as the wideband pulse position candidate 27*a*, and an odd-number sample position pulse position candidate 27*e* comprising odd-number sample positions is used as the pulse position candidate 27*b* for the narrowband signal.

Figures 7, 8:
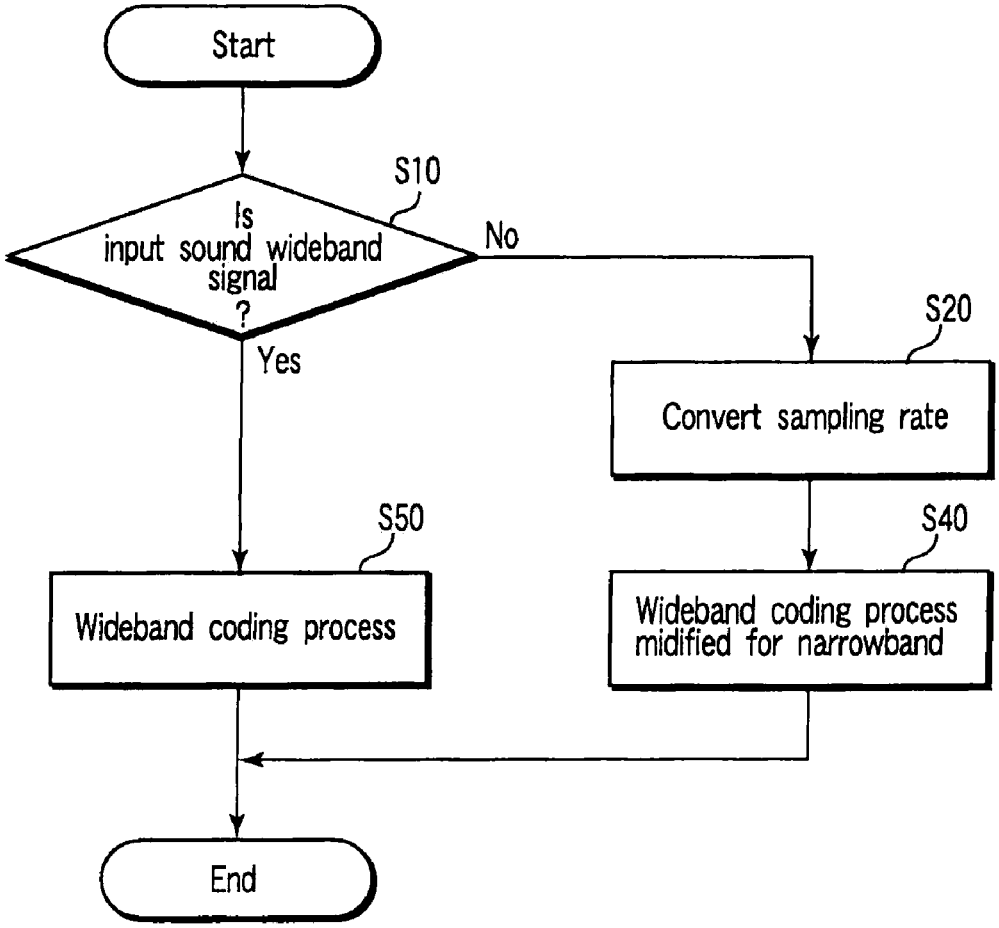
FIG. 7 is a diagram showing pulse position candidates of odd-number sample positions shown in FIG. 6.
FIG. 8 is a flowchart showing a control procedure and contents by a control unit of the wideband speech coding apparatus shown in FIG. 1.

FIG. 7 shows the pulse position candidates 27*e* of the odd-number sample positions. The pulse position candidate 27*e* of the odd-number sample position is constituted in such a manner that the pulse is selected from the pulse position candidates disposed only in the odd-number sample positions. Even in this case, a similar effect is obtained.

In the pulse position candidate 27*e* of the odd-number sample position, the excitation signal is represented by five pulses, and each pulse has an amplitude of "+1" to "−1". In the algebraic codebook shown in FIG. 7, the pulse position candidate capable of putting each pulse is disposed only in the odd-number sample positions among the sample positions of 0 to 63 in the sub-frame. In the sub-frame, the odd-number sample position is divided into five tracks, and each track includes only one pulse.

For example, pulse i0 is selected from one position among candidates {1, 9, 17, 25, 33, 41, 49, 57} of the pulse positions included in track 1. In this example, three bits are given to 8 types of pulse position candidates in coding the pulses, and one bit is given to the pulse amplitude per track. Then, when 20 bits are given, it is possible to put five pulses. That is, (3+1)×5=20 bits.

It is to be noted that the above-described constitution of the algebraic codebook is one example, and various constitutions can be considered with respect to the track. In short, the pulses for the narrowband are selected from the candidates of the odd-number sample positions.

Still another constitution is also possible as the narrowband pulse position candidate 27*b*. For example, the even-number sample position and the odd-number sample position are switched for each sub-frame, or the even-number sample position and the odd-number sample position may be constituted to be switched every plurality of sub-frames.

In short, in a constitution in which the pulse position candidate for the narrowband is in a thinned-out sample position compared with the pulse position candidate for the wideband, and the candidate of the pulse position is given at a thin-out ratio to a degree corresponding to a ratio of a bandwidth of the narrowband to that of the wideband, the pulse position candidate for use in the excitation for the narrowband sufficiently functions.

As described above, in the first embodiment, it is assumed that the bandwidth of the narrowband speech signal is about 4 kHz (a case where originally an 8 kHz sampling input signal is sampled up into 16 kHz) and, on the other hand, the bandwidth of the wideband speech signal is about 8 kHz (signal usually sampled at 16 kHz). Therefore, in a method of thinning out the sample position for the narrowband, the pulse position candidate may be constituted to be positioned in a position where the sampling rate is lowered to ½ (needless to say, a thin-out ratio of ½ or more, such as ⅔, may be set). Therefore, the narrowband pulse position candidate is constituted in such a manner that the position is thinned out into ½ as compared with the wideband pulse position candidate 27*a*.

If anything is not considered in coding the speech signal of the narrowband in the wideband speech coding unit, for example, as shown in FIG. 4, the pulse position candidate having a high time resolution equal to that of a usual wideband signal like the wideband pulse position candidate 27*a* is used.

When the position candidate having a high time resolution is used in this manner, several pulses that can be put with a limited bit number are sometimes excessively concentrated in adjacent integer samples for an unnecessarily fine resolution. In this case, any pulse is not allocated to other position, and the excitation signal is insufficient. Therefore, the quality of the reproduced speech deteriorates.

In the first embodiment, it is identified whether the input speech signal is a wideband signal or a narrowband signal. Moreover, when the input speech signal has been the narrowband signal, the pulse position candidate having a low resolution adapted to the narrowband signal is used. Therefore, the bit representing the pulse position can be prevented from being wasted in a high-band signal. Furthermore, the pulse is limited in such a manner as to put only in a position having a low time resolution. Therefore, a plurality of pulses representing the excitation signal is not unnecessarily concentrated, and much more pulses can be put. Therefore, it is possible to reproduce a higher quality speech in an apparatus on a decoding side.

In FIG. 2, the noise codebook searching section 25 searches a code of a code vector whose distortion is minimum, that is, a noise code (K) using the algebraic codebook comprising the position candidates of the pulses output from the pulse position candidate setting section 27. The algebraic codebook limits possible amplitude values of predetermined Np pulses to "+1" and "−1", and outputs pulses which is put in accordance with position information and amplitude information (i.e., polarity information) of the pulses as a code vector.

Features of the algebraic codebook lies in the point that the code vector itself are not directly stored, but only arrangement information with respect to the pulse position candidate and pulse polarity may be stored. Therefore, memory amount required to represent the codebook may be small. Although a calculation amount for selecting the code vector is small, noise components included in excitation information can be represented in a comparatively high quality.

A system in which the algebraic codebook is used in coding the excitation signal in this manner is referred to as an algebraic code excited linear prediction (ACELP) system, and it is known that synthesized speech having a comparatively small distortion is obtained.

Under this constitution, into the noise codebook searching section 25, the position candidates of the pulses output from the pulse position candidate setting section 27, the second target signal X2 output from the adaptive codebook searching section 24, and the impulse response h(n) output from the impulse response calculation section 23 are input. The noise codebook searching section 25 evaluates the distortions of the perceptual weighted synthesized code vector and the second target signal X2. Moreover, the index whose distortion is reduced, that is, the noise code (K) is searched. It is to be noted that the above-described perceptual weighted synthesized code vector is produced using the code vector output from the algebraic codebook in accordance with the pulse position candidate.

At this time, the following evaluation value is used:

$$(X2^tHck)^2/(ck^tH^tHck) \tag{6}$$

The searching of the code of the code vector which maximizes this evaluation value is equivalent to the selecting of the code whose code vector's distortion is minimized. Here, superscript t denotes transposition of matrix, H denotes an impulse response matrix comprising the impulse response h(n), and ck denotes a code vector from the codebook corresponding to code k.

The noise codebook searching section 25 outputs the above-described searched noise code (K), the code vector corresponding to the noise code (K), and the perceptual weighted synthesized code vector. The noise code (K) constitutes a part of the output code 19.

When the noise codebook is realized by the algebra codebook, the noise code (K) comprises several (here Np) nonzero pulses. Therefore, the numerator of the above-described evaluation value can be further represented by the following:

$$X2^tHck = \sum_{i=0}^{N_p-1} \vartheta_i f(m_i) \tag{7}$$

where mi denotes the position of an i-th pulse, θj denotes an amplitude of the i-th pulse, and f(n) denotes an element of a correlation vector X2*t*H. A denominator of the above-described evaluation value can be represented by the following:

$$ck^tH^tHck = \sum_{i=0}^{N_p-1} \varphi(m_i, m_i) + 2\sum_{i=0}^{N_p-2}\sum_{j=i+1}^{N_p-1} \vartheta_i\vartheta_j\varphi(m_i, m_j) \tag{8}$$

Based on them, searching pulse position mj (i=0 to Np) such that distortion evaluation value (X2*t*Hck)2/(cktHtHck) is maximum completes the selection of the pulse position information. Here, the pulse position mj to be searched is limited to the pulse position candidate set by the pulse position candidate setting section 27. Thus, even when the algebraic codebook comprises the pulse position candidate output from the pulse position candidate setting section 27, it is possible to search the algebraic codebook.

Moreover, at this time, necessary values of f(n) and ϕ(i, j) for use in searching the code are calculated in advance. Thus, the calculation amount required for searching the code becomes very small. The pulse position information selected in this manner is output together with pulse amplitude information as the noise code (K). The noise codebook searching section 25 outputs the code vector corresponding to the noise code, and the perceptual weighted synthesized code vector.

The perceptual weighted synthesized adaptive code vector output from the adaptive codebook searching section 24, and the perceptual weighted synthesized code vector output from the noise codebook searching section 25 are input into the gain codebook searching section 26. The gain codebook searching section 26 codes two types of gains: a gain for the adaptive code vector; and a gain for the code vector in order to represent the gain component of the excitation. It is to be noted that for the sake of simplicity, the above-described two types of gains will be hereinafter referred to simply as the gain.

The gain codebook searching section 26 searches a gain code (G) which is such an index that the distortions of the perceptual weighted synthesized speech signal and the target signal (X(n) in this embodiment) are reduced. Moreover, the section outputs the searched gain code (G) and the corresponding gain. The gain code (G) constitutes a part of the output code 19. It is to be noted that the perceptual weighted synthesized speech signal is reproduced using the gain candidate selected from the gain codebook.

The excitation signal production section 28 produces an excitation signal using the adaptive code vector output from the adaptive codebook searching section 24, the code vector output from the noise codebook searching section 25, and the gain output from the gain codebook searching section 26.

As to the excitation signal, the adaptive code vector is multiplied by the gain for the adaptive code vector, and the code vector is multiplied by the gain for the code vector. Moreover, when the adaptive code vector multiplied by this gain and the code vector multiplied by the gain are summed, the excitation signal is obtained. It is to be noted that the method of producing the speech signal is not limited to this method.

The obtained speech signal is stored in the adaptive codebook in the adaptive codebook searching section 24 for use in the adaptive codebook searching section 24 in the next coding interval. Furthermore, the produced excitation signal is also used for calculating the target signal in the next coding interval in the target signal production section 22.

Next, a speech coding process procedure and contents in the wideband speech coding apparatus according to the first embodiment of the present invention will be described. FIG. 8 is a flowchart showing the speech coding process procedure and contents.

A detection unit identifies whether or not the input speech signal is a wideband signal (step S10). As a result of identification, when the signal is a wideband signal, coded data is produced by performing predetermined wideband coding (step S50), and the process ends. On the other hand, when the narrowband signal is identified, the sampling rate of the input signal is converted as an exceptional process in such a manner as to be adapted to a sampling rate (usually 16 kHz) assumed in the wideband speech coding unit (step S20). Next, the wideband speech coding process whose contents have been modified by using a parameter for narrowband for performing exceptional wideband speech coding is performed, accordingly coded data is produced (step S40), and the process ends.

It is to be noted that in step S40, a portion to modify the process contents for the narrowband is a coding process which is at least a part of the wideband speech coding process. As one example, the candidate of the pulse position for use in the speech code searching unit is modified.

The wideband speech coding method of the present invention has been described above with reference to the flowchart of FIG. 8.

Second Embodiment

Figure 9:
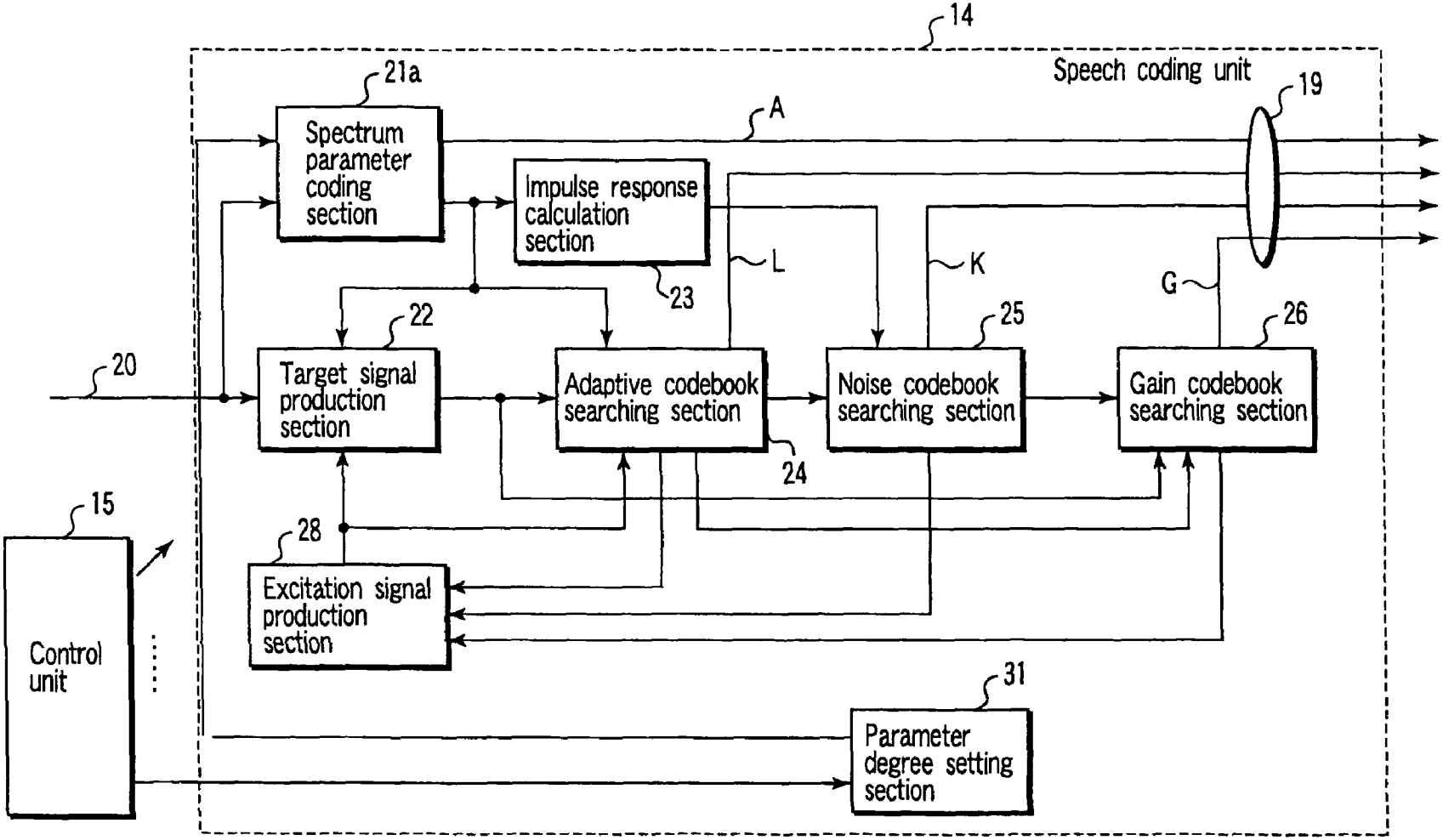
FIG. 9 is a block diagram showing a constitution of the speech coding unit according to a second embodiment of the present invention.

Next, a wideband speech coding method and apparatus according to a second embodiment of the present invention, mainly different respects from the first embodiment will be described with reference to the drawings. FIG. 9 is a block diagram showing a constitution of a speech coding unit 14 according to the second embodiment of the present invention. It is to be noted that in FIG. 9; the same part as that of FIG. 2 is denoted with the same reference numerals, and detailed description is omitted.

The speech coding unit 14 comprises a parameter degree setting section 31. The parameter degree setting section 31 outputs a parameter degree. Moreover, a spectrum parameter coding section 21*a* performs an operation similar to the spectrum parameter coding section 21 according to the first embodiment, the parameter degree is variable, and the section inputs and uses the parameter degree output by the parameter degree setting section 31.

Moreover, the pulse position candidate setting section 27 and the narrowband pulse position candidate 27*b* are not disposed, and a wideband pulse position candidate 27*a* is disposed in a noise codebook searching section 25. It is to be noted that the wideband pulse position candidate 27*a* is omitted from FIG. 9.

The parameter degree setting section 31 sets the degree of the LSP parameter for use by the spectrum parameter coding section 21*a* based on a notice from a control unit 15. That is, on receiving notice indicating that the sampling rate of the input speech signal is 16 kHz, the parameter degree setting section 31 selects and outputs an LSP degree for wideband. On receiving notice indicating that the rate is 8 kHz, the section selects and outputs an LSP degree for narrowband.

When the input signal is a wideband signal including 7 to 8 kHz band, p=about 16 to 20 is used as an LSP degree p. When the input speech signal is a narrowband signal, a value of p=about 10 is exceptionally used. Since the LSP degree can be limited to an appropriate degree for the narrowband signal in this manner, the number of bits required for coding the spectrum parameters can be accordingly reduced.

It is to be noted that even when the spectrum parameter used by the spectrum parameter coding section 21*a* is not the LSP parameter but the LPC parameter, the K parameter, the ISF parameter or the like, it is possible to perform a process of limiting the degree to a degree appropriate for the narrowband signal in the same manner as in the LSP parameter.

A control operation of the control unit 15 in the second embodiment is substantially the same as that (shown in the flowchart of FIG. 8) of the control unit 15 according to the first embodiment. Additionally, the wideband coding process of the step S50 is realized, when the LSP degree for the wideband is set to the parameter degree setting section 31, and the coding process of the wideband speech is performed by the speech coding unit 14.

Moreover, the narrowband coding process of the step S40 is realized, when the LSP degree for the narrowband is set to the parameter degree setting section 31, and the coding process of the narrowband speech is performed by the speech coding unit 14.

It is to be noted that the wideband speech coding method and apparatus according to the present invention are not limited to the above-described first and second embodiments. For example, the number of parameters, the number of coding candidates and the like for use in a preprocess section, adaptive codebook searching section, pitch analysis section, or gain codebook searching section can be adaptively controlled in accordance with the sampling rate conversion of the input speech signal in case that the sampling rate of the input speech signal is converted, or by using identification information indicating that the input speech signal is a wideband signal or a narrowband signal.

Moreover, it is also possible to apply the present invention to bit rate control of variable rate wideband speech coding. That is, when it is identified that the input speech signal is a wideband signal or a narrowband signal, it is possible to efficiently control the bit rate of the above-described wideband speech coding means.

For example, when the input speech signal is a wideband signal, the input signal is suitable for the wideband speech coding unit, and therefore the coding bit rate can be lowered to a certain degree. On the other hand, when the input speech signal is a narrowband signal, the signal is not assumed in the wideband speech coding unit usually as described above, and therefore coding efficiency tends to be bad. In this case, the bit rate is controlled in such a manner that the coding bit rate becomes high. However, the bit rate does not have to be controlled in such a manner as to raise the bit rate with respect to a speechless interval of the input speech signal.

That is, only when the input speech signal is detected as the narrowband signal, and speech activity is high in judgment of presence of speech or the like, the bit rate judgment section is controlled in such a manner as to raise the coding bit rate. Then, the bit rate can be suppressed to be low in the interval in which the activity of the speech is low, and therefore the average bit rate can be lowered.

In this constitution, in the wideband speech coding apparatus, there is an effect that a certain or better quality can be stably provided, whether the input speech signal is a wideband signal or a narrowband signal.

Third Embodiment

Figure 11:
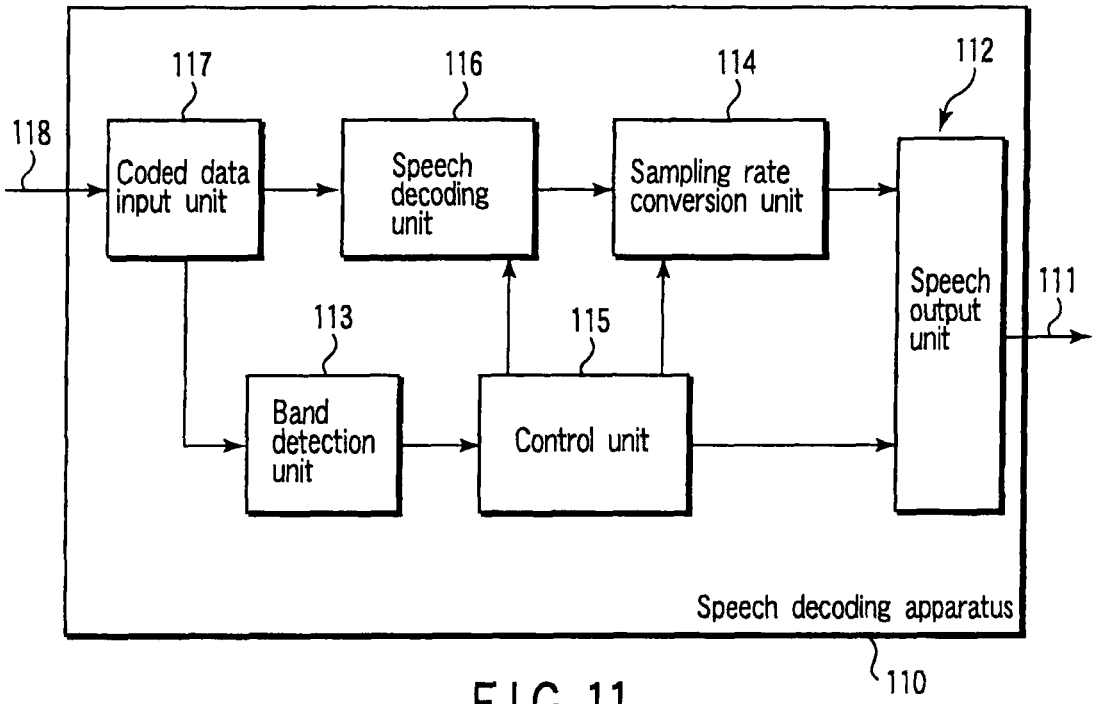
FIG. 11 is a block diagram showing a constitution of a wideband speech decoding apparatus according to a third embodiment of the present invention.
Figure 12:
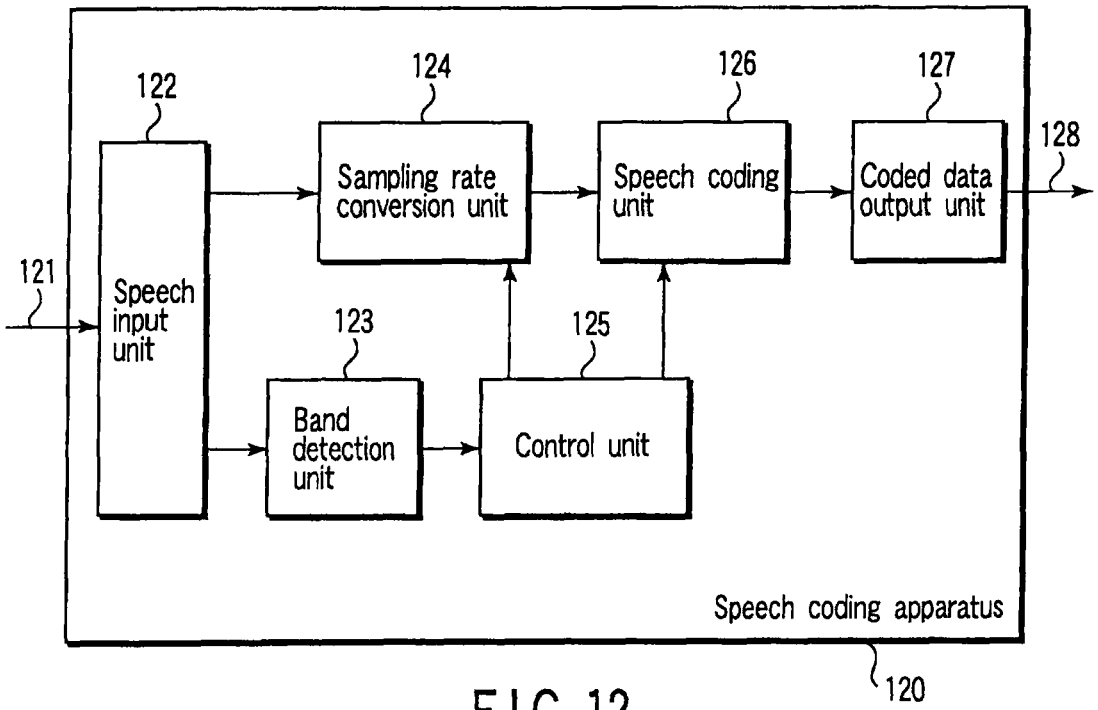
FIG. 12 is a block diagram showing an example of the wideband speech coding apparatus for producing coded data according to a third embodiment of the present invention.

A third embodiment of the present invention will be described hereinafter with reference to FIG. 11 and FIG. 12. FIG. 11 is a block diagram showing an example of a wideband speech decoding apparatus according to the third embodiment of the present invention. FIG. 12 is a block diagram showing one example of a wideband speech coding apparatus which produces coded speech data input into the above-described wideband speech decoding apparatus.

In case of a mobile communication system, the wideband speech decoding apparatus is used in a reception system, and the wideband speech coding apparatus is used in a transmission system. The wideband speech decoding apparatus is also used in reproducing coded data recorded as contents.

First, the wideband speech coding apparatus for producing coded data to be input into a wideband speech decoding apparatus 110 will be described with reference to FIG. 12.

In FIG. 12, a wideband speech coding apparatus 120 comprises a speech input unit 122, a band detection unit 123, a control unit 125, a sampling rate conversion unit 124, a speech coding unit 126, and a coded data output unit 127.

An operation of the wideband speech coding apparatus 120 will be described with reference to FIG. 12. The speech input unit 122 receives a speech signal 121, and further acquires identification information on the band of the input speech signal. The identification information can be acquired from the input speech signal, acquisition path, acquisition history and the like. Here, a case where the information is acquired from sampling rate information of the input speech signal will be described as an example. The speech input unit 122 sends the acquired sampling rate information to the band detection unit 123, and further supplies the input speech signal to the sampling rate conversion unit 124.

The speech input unit 122 is not limited to a unit for real-time communication, which inputs and digitalizes speech via a microphone, and the unit may read and input speech data from a file in which speech information is stored as digital data. In this case, identification information on the band can be acquired, for example, by reading attribute information attached to the corresponding speech information file from a header portion or the like.

The band detection unit 123 receives sampling rate information of the input speech signal output from the speech input unit 122, and outputs band information detected based on the received sampling rate information. The band information may be sampling rate information itself, or mode information including the sampling rate set beforehand in accordance with the sampling rate information. For example, when the sampling rate information of the speech signal assumed by the speech input unit 122 is two types "16 kHz" or "8 kHz", "16 kHz" corresponds to mode "0". When the sampling rate information indicates "8 kHz", mode "1" corresponds. Furthermore, in a case where the sampling rate information which is not assumed by the speech input unit 122 is acquired (corresponding to a case where the information is neither "16 kHz" nor "8 kHz" in this example), a mode (e.g., mode "unknown") apart from the above-described mode is prepared beforehand. Thus, in a case where a speech signal having a sampling rate which is not assumed by the speech coding unit 126 is input, a countermeasure can be performed, for example, a coding operation is not performed.

The control unit 125 controls the sampling rate conversion unit 124 and the speech coding unit 126 based on band information from the band detection unit 123. Concretely, when the input speech signal does not match the sampling rate of the input speech signal assumed by the speech coding unit 126, the sampling rate of the input speech signal is converted in such a manner as to match the assumed rate, and the converted input speech signal is input into the speech coding unit 126. On the other hand, when the input speech signal matches the sampling rate of the input speech signal assumed by the speech coding unit 126, the sampling rate of the input speech signal is not converted. Moreover, the input speech signal is input into the speech coding unit 126 as such.

For example, when the sampling rate of the input speech signal assumed by the speech coding unit 126 is 16 kHz, and the sampling rate of the input speech signal output from the speech input unit 122 is 8 kHz, the sampling rate does not match that of the input speech signal assumed by the speech coding unit 126. Therefore, after sampling up the input speech signal having a sampling rate of 8 kHz into a speech signal having a sampling rate of 16 kHz, the speech signal is input into the speech coding unit 126. On the other hand, when the sampling rate of the input speech signal assumed by the speech coding unit 126 is 16 kHz, and the sampling rate of the input speech signal output from the speech input unit 122 is also 16 kHz, the sampling rate matches that of the input speech signal assumed by the speech coding unit 126. Therefore, the input speech signal is input into the speech coding unit 126 as such without converting the sampling rate of the input speech signal.

The speech coding unit 126 codes the input speech signal by predetermined wideband speech coding, and integrally outputs the corresponding coded data to the coded data output unit 127. As an example of a coding algorithm for use in the speech coding unit 126, wideband speech coding based on CELP system is considered such as AMR-WB described in ITU-T Recommendation G.722.2.

At this time, the control unit 125 selects and reads a coding parameter for the wideband or narrowband from memory for the coding parameter, contained therein, based on identification information of the band. Moreover, the speech coding unit 126 performs coding using the selected coding parameter. The coded data output unit 127 incorporates the identification information of the band into a part of the coded data, and outputs the information. It is to be noted that it is a matter to be appropriately designed to judge how to incorporate the information.

Moreover, in another realizing method, the identification information of the band may be output as side information and data of a system apart from that of the coded data. This is also a matter to be appropriately designed. The information is not incorporated in some case.

Next, details of the wideband speech decoding apparatus according to the third embodiment of the present invention will be described with reference to FIG. 11.

In FIG. 11, the wideband speech decoding apparatus 110 comprises a coded data input unit 117, a band detection unit 113, a control unit 115, a speech decoding unit 116, a sampling rate conversion unit 114, and a speech output unit 112.

The coded data input unit 117 separates input coded data into information of a speech parameter code and identification information of the band, information of a speech parameter code is sent to the speech decoding unit 116, and the identification information of the band is sent to the band detection unit 113.

The band detection unit 113 outputs the band information detected based on the identification information of the band to the control unit 115. The band information may be sampling rate information itself, or mode information on the sampling rate set beforehand in accordance with the sampling rate information. For example, when the sampling rate information of the speech signal assumed by the speech input unit 122 is two types "16 kHz" and "8 kHz", "16 kHz" corresponds to mode "0". When the sampling rate information indicates "8 kHz", mode "1" corresponds. Furthermore, in a case where the sampling rate information which is not assumed by the speech input unit 122 is acquired (corresponding to a case where the information is neither "16 kHz" nor "8 kHz" in this example), a mode (e.g., mode "unknown") apart from the these modes is prepared beforehand. Thus, even in a case where the speech signal having a sampling rate which is not assumed by the speech coding unit 126 is sometimes input, a defect of a decoding process can be prevented from being generated.

Thus, the band identification information incorporated as a part of the coded data, or sent as data attached to the coded data is extracted by the coded data input unit 117, and sent to the band detection unit 113. The format of the coded data may be, for example, a data format in the form of the band identification information received as a part of the coded data, or a data format which is attached to the coded data and received.

As another embodiment, a case where the identification information of the band is not incorporated into a part of the coded data is also possible. For example, the identification information of the band can be input from the outside of the wideband speech coding apparatus 123 by input means.

Moreover, in another embodiment, it is also possible to identify the band of the speech signal reproduced by decoding based on a signal (e.g., speech signal or excitation signal) reproduced inside the speech decoding unit, or based on a spectrum parameter representing an outline of spectrum of the speech signal.

Figure 19:
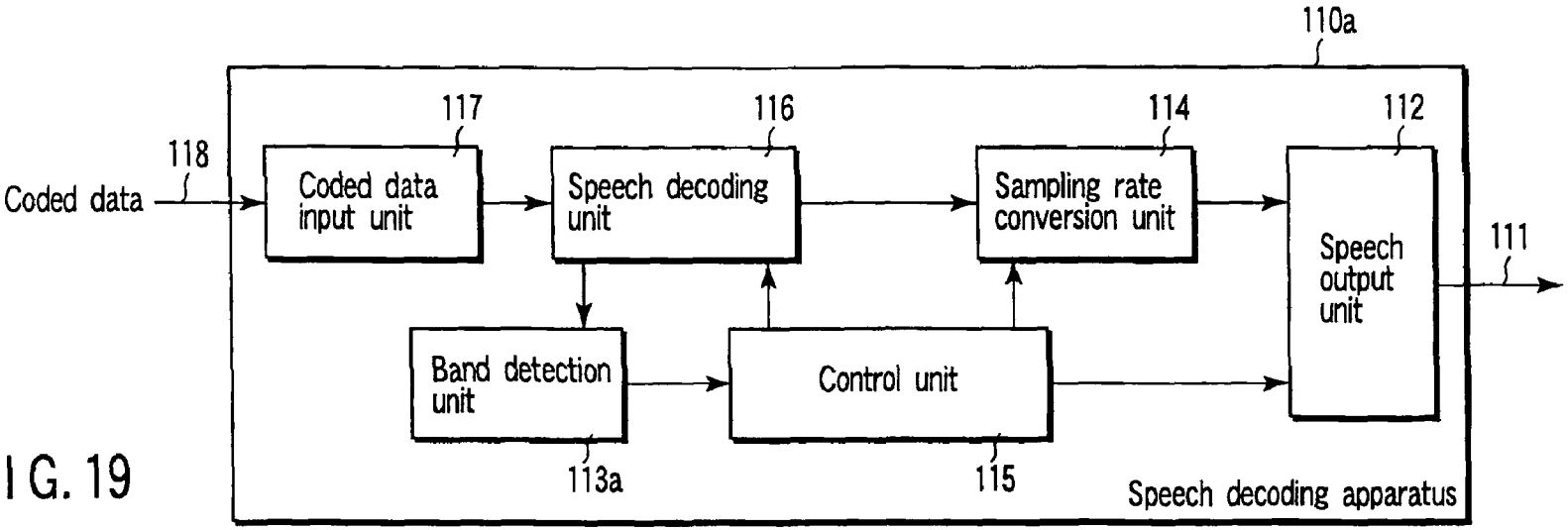
FIG. 19 is a block diagram showing a constitution of the wideband speech decoding apparatus according to another embodiment of the present invention.

FIG. 19 shows a constitution example. That is, for example, the speech decoding unit 116 analyzes a range of frequencies indicated by the spectrum parameter representing the outline of the spectrum of the speech signal, and can accordingly identify the band of the speech signal reproduced by the decoding unit. The identification information of the band extracted in this manner is sent to the band detection unit 113. In this case, the control is possible using the identification information of the band without transmitting the identification information of the band itself. As a result, necessity for information for incorporating the identification information of the band into a part of the coded data can be obviated.

Figure 20:
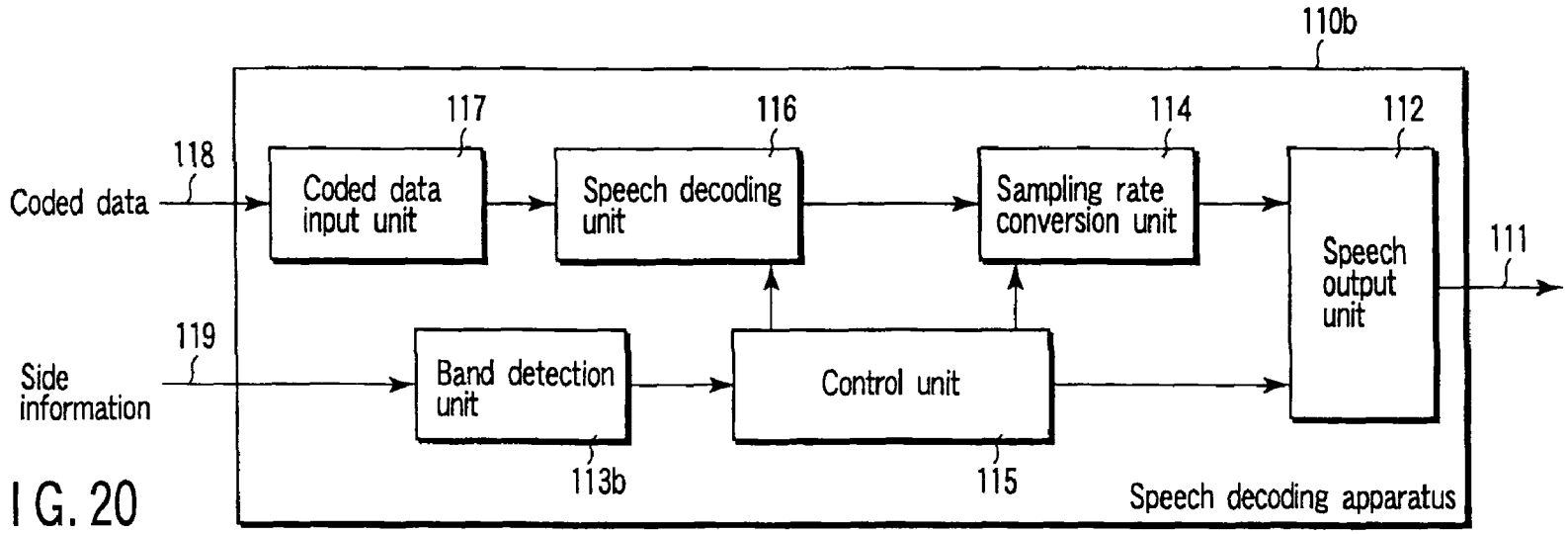
FIG. 20 is a block diagram showing a constitution of the wideband speech coding apparatus according to another embodiment of the present invention.

Furthermore, as another embodiment, as shown in FIG. 20, the identification information of the band may be extracted from the data transmitted as side information from a coding apparatus side apart from the coded data.

Moreover, in a method of transmitting the identification information of the band from a coding apparatus side, on a decoding apparatus side, identification information SA of the received band is compared with identification information SB of the band obtained by analyzing the spectrum parameter representing the outline of the speech signal or the spectrum of the speech signal. Thus, when the identification information SA is different from the identification information SB, an effect that it can be detected that there is an error in received data is also produced.

A control unit 115 controls a speech decoding unit 116, sampling rate conversion unit 114, and speech output unit 112 based on band information from a band detection unit 113. A concrete control method will be described in the following description of the speech decoding unit 116, sampling rate conversion unit 114, and speech output unit 112.

The speech decoding unit 116 inputs information of speech parameter codes from the coded data input unit 117, and reproduces the speech signal using information of these. In this case, the speech decoding unit 116 is controlled based on the band information from the control unit 115. An example of a method of controlling the speech decoding unit 116 based on the band information will be described in detail with reference to FIG. 13.

Figure 13:
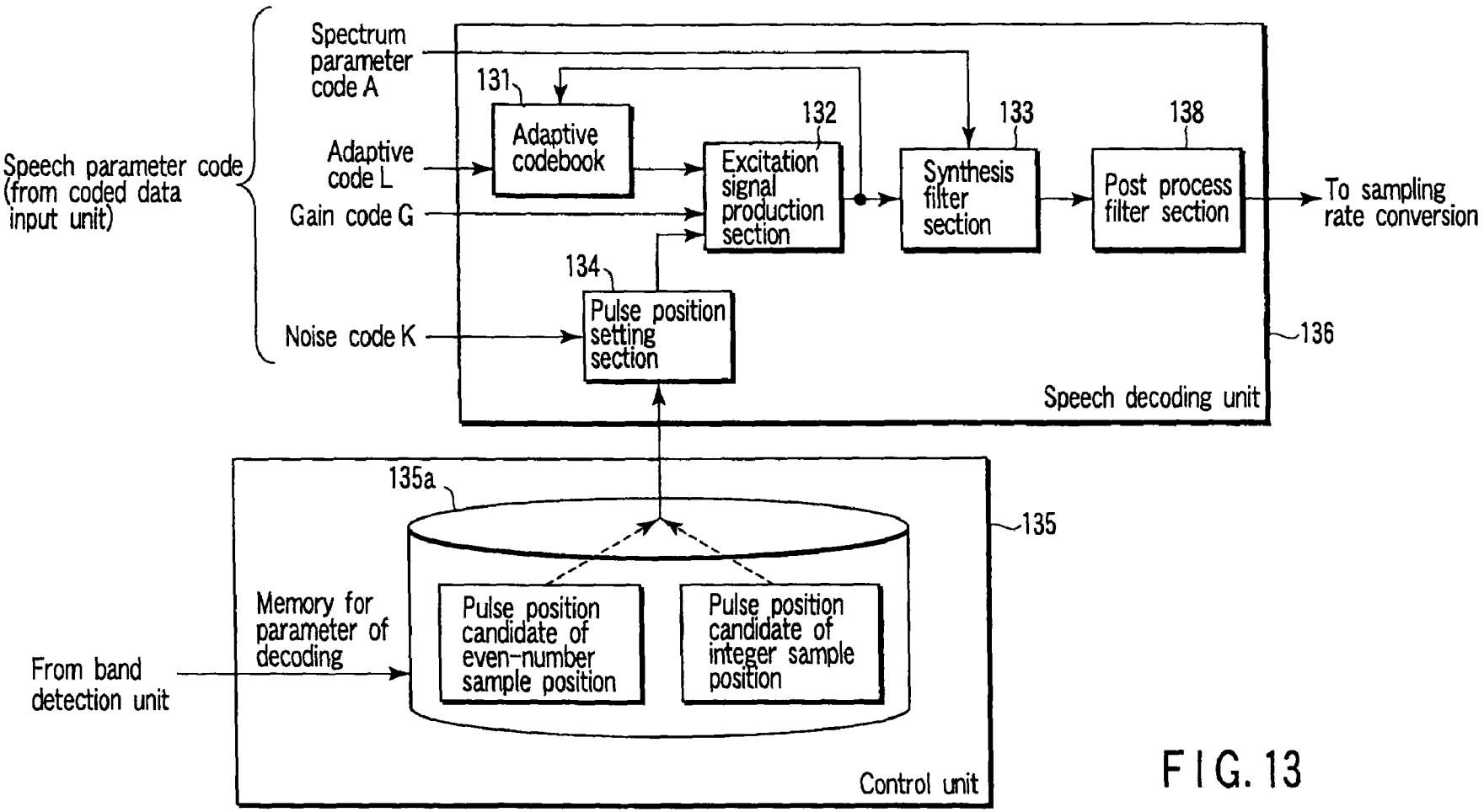
FIG. 13 is a block diagram showing constitutions of a speech decoding unit and a control unit of the wideband speech decoding apparatus shown in FIG. 11.

In FIG. 13, a speech decoding unit 136 comprises an adaptive codebook 131, an excitation signal production section 132, a synthesis filter section 133, a pulse position setting section 134, and a post process filter section 138. In this embodiment, a control unit 135 contains a memory for parameter of the decoding unit.

Here, an example in which the speech decoding unit 136 uses speech decoding corresponding to a wideband speech coding system of a CELP system such as AMR-WB will be described. In this case, information of an input speech parameter code comprises a spectrum parameter code A, an adaptive code L, a gain code G, and a noise code K.

The adaptive codebook 131 stores the excitation signal output from the excitation signal production section 132 described later as a past excitation signal in a codebook. Moreover, a past excitation signal by a pitch period corresponding to the adaptive code L is output based on the adaptive code L.

The pulse position setting section 134 produces a noise code vector corresponding to the noise code K. Here, the noise code vector can be produced using a predetermined algebraic codebook. The noise code vector comprises a small number of pulses. A pulse amplitude, polarity, and pulse position are produced based on the noise code K with respect to the respective pulses constituting the noise code vector. The number of pulses, candidates of positions capable of putting the pulses (pulse position candidates), the pulse amplitude in the position, and the polarity of the pulse are determined depending on the presetting of the algebraic codebook. For example, in a variable bit rate coding system such as AMR-WB, setting of a structure of the algebraic codebook for each bit rate is uniquely determined. On the other hand, in the third embodiment of the present invention, even with the same bit rate, the setting of the structure of the algebraic codebook changes according to the band information.

That is, in FIG. 13, the control unit 135 has two types of pulse position candidates in the memory for parameter of the decoding unit. Moreover, the pulse position candidate corresponding to the band information is given to the pulse position setting section 134. Accordingly, the setting of the pulse position of the algebraic codebook of the pulse position setting section 134 is controlled. The pulse is put in the pulse position corresponding to the noise code K using the pulse position candidate set in this manner, and the noise code vector is produced and output by the pulse position setting section 34.

The example of FIG. 13 shows a constitution which switches "the pulse position candidate of the even-number sample position" and "the pulse position candidate of the integer sample position" as two types of pulse position candidates. When the band information indicates wideband, the pulse position candidate of the integer sample position is set in the same manner as in the conventional constitution.

On the other hand, when the band information indicates narrowband, reproduced speech signal is a narrowband signal which does not have a high frequency in the band of the speech signal. Therefore, the sampling rate for representing the noise code vector which is a base to produce the excitation signal can be sufficiently represented by the sampling rate which is lower than the rate corresponding to the wideband signal. Therefore, when the band information indicates narrowband, the pulse position candidate of the thinned-out sample position (in the example of FIG. 13, the pulse position candidate of the even-number sample position) is set. The pulse position candidate of the thinned-out sample position may be, for example, the pulse position candidate of the odd-number sample position and, needless to say, is not limited to this.

Thus, when the band information indicates narrowband, the necessary number of bits for representing the pulse position information can be reduced, and there is an effect that the number of bits transmitted from the coding side can be reduced. In the coding and transmitting at the equal bit rate, other information is transmitted to thereby improve a speech quality, or the bits which can be reduced by the position information of the pulse can be effectively used to raise a code error resistance. Alternatively, the bits reduced with respect to the position information of the pulse is usable for putting more pulses, or for raising the resolution of quantization of the pulse amplitude. Thus, even when the narrowband signal is decoded and reproduced in the wideband decoding at the low bit rate, the speech quality can be improved.

Using the gain code G, the excitation signal production section 132 obtains the gain for use in the adaptive code vector from the adaptive codebook 131 and the gain for use in the noise code vector from the pulse position setting section 134. Moreover, the adaptive code vector and the noise code vector to which the gains have been applied are added up to thereby produce the excitation signal. The excitation signal is input into the synthesis filter section 133 and the adaptive codebook 131.

The synthesis filter 133 decodes the spectrum parameter representing the outline of the spectrum of the speech signal from the spectrum parameter code A, and obtains a filter coefficient of the synthesis filter using the parameter. The excitation signal from the excitation signal production section 132 is input into the synthesis filter constituted using the filter coefficient obtained in this manner. In this case, the speech signal is produced as the output of the synthesis filter 133.

The post process filter section 138 arranges the shape of the spectrum of the speech signal produced by the synthesis filter 133. Accordingly, the speech signal whose subjective speech quality has been improved may be the output of the speech decoding unit. Although not clearly shown in FIG. 13, the typical post process filter section 138 arranges the outline of the spectrum of the speech signal using the spectrum parameter or the filter coefficient of the synthesis filter. The section suppresses coding noises existing in the frequency of a valley portion, and permits the coding noises existing in the frequency of a mountain portion to a certain degree in a concave/convex shape of the spectrum based on the output of the spectrum of the speech signal. By doing in this way, the coding noise is masked with the speech signal, and is arranged so that the noise is not easily perceived by the human ear.

In this manner, the reproduced speech signal is output from the speech decoding unit 136.

In FIG. 11, the sampling rate conversion unit 114 receives the speech signal output from the speech decoding unit. Moreover, when the band information indicates the wideband based on the band information from the control unit 115, the speech signal from the speech decoding unit 116 is output to the speech output unit 112 as such without converting the sampling rate.

On the other hand, when the band information from the control unit 115 indicates the narrowband, it is seen that the speech signal input into the sampling rate conversion unit 114 from the speech decoding unit is a narrowband signal which does not have a high frequency. In this case, the sampling rate conversion unit 114 converts the speech signal input from the speech decoding unit at the sampling rate (typically 16 kHz sampling) corresponding to the wideband signal into a low sampling rate (typically 8 kHz sampling) for the narrowband signal to output the signal.

Thus, according to the detected band information, the sampling rate of the speech signal from the speech decoding unit is converted (sampling-down in the above-described example). By this, the speech signal at the sampling rate corresponding to a substantial frequency band contained in the speech signal can be acquired as data. In other words, the signal is originally a narrowband speech signal, but is decoded into a wideband speech, and is accordingly represented by the excessively high sampling rate for the wideband speech, and the speech signal data is enlarged. This can be avoided by the use of the present invention.

The speech output unit 112 inputs the speech signal from the sampling rate conversion unit 114, and outputs an output speech 111 for each sample at a timing in accordance with the sampling rate corresponding to the band information from the control unit 115. The speech output unit 112 comprises, for example, a digital-to-analog conversion section and a driver, converts the speech signal from the sampling rate conversion unit 114 into an analog electric signal based on wide/narrow identification information of the band from the control unit 115, and drives a speaker (not shown in FIG. 11) to output the speech.

It is to be noted that besides, when a digital output speech is recorded in a memory or the like or transferred, based on information indicating the narrowband speech signal or the wideband speech signal, a data amount can be reduced by sampling-down the speech signal to 8 kHz in case of the narrowband speech signal. By this, the memory is effectively utilized, or a transfer time can be reduced. When the band information such as the sampling rate is associated with the speech signal and recorded or transferred, the recorded or transferred speech signal can be correctly reproduced at a correct sampling rate.

Figure 16:
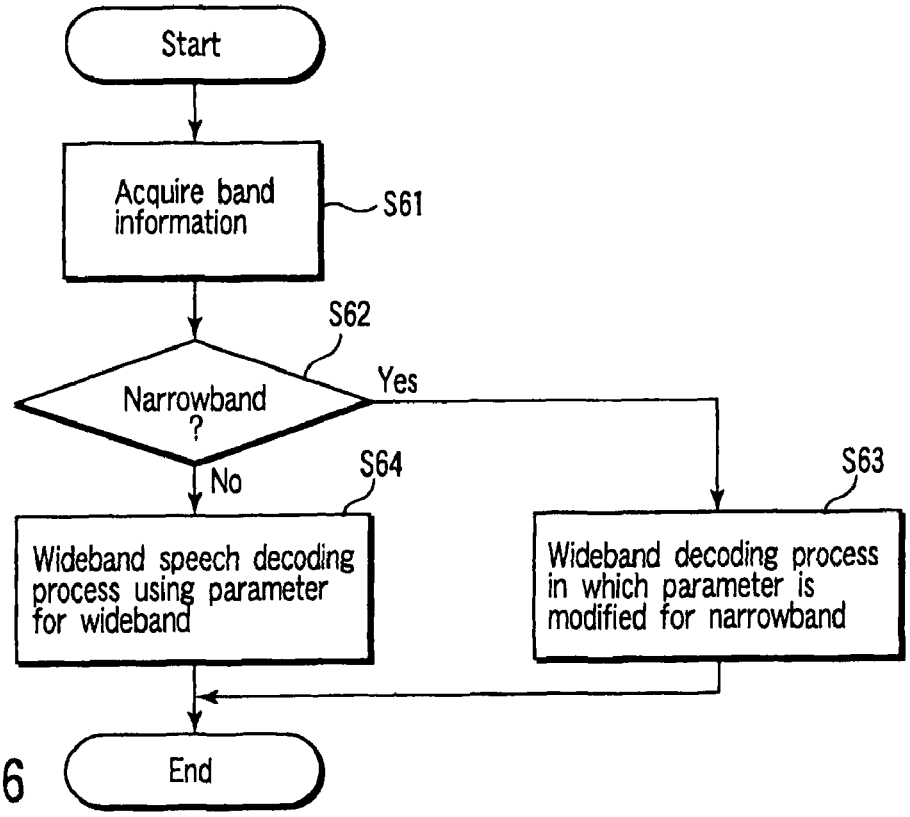
FIG. 16 is a flowchart showing a procedure and contents of a speech decoding process according to the third embodiment of the present invention.

FIG. 16 is a flowchart showing an operation which is a gist of the wideband speech decoding apparatus according to the third embodiment of the present invention.

An operation of the wideband speech decoding apparatus will be described hereinafter with reference to the figure.

First, when the process starts, the band detection unit 113 acquires the sent band information incorporated in the coded data (step S61). Moreover, it is determined whether to perform the process for the wideband or the narrowband based on the acquired band information (step S62).

When it is determined that the process for the narrowband be performed, the control unit 115 modifies a predetermined parameter for use in the decoding in the speech decoding unit 116 for the narrowband. Moreover, the speech decoding unit 116 produces the speech signal from the input coded data (step S63), and the process ends.

On the other hand, when it is determined that the process for the wideband be performed, the control unit 115 sets a predetermined parameter for use in the decoding in the speech decoding unit 116 for the wideband. Subsequently, the speech decoding unit 116 produces the speech signal from the input coded data (step S64), and ends the process.

According to the third embodiment of the present invention, an appropriate parameter for the decoding is selected based on the band information. By this, even in the case that either the wideband speech signal or the narrowband speech signal is produced in the wideband speech decoding process, the speech signal can be decoded with a high quality in accordance with the band information.

Fourth Embodiment

A fourth embodiment of the present invention is characterized in that an excitation signal produced in decoding is modified in accordance with distinction of wideband or narrowband of detected band information.

As an example of a method of modifying the excitation signal, strength or presence of emphasis of pitch periodicity or formant can be selected in accordance with distinction of the wideband or the narrowband of the detected band information.

Figure 14:
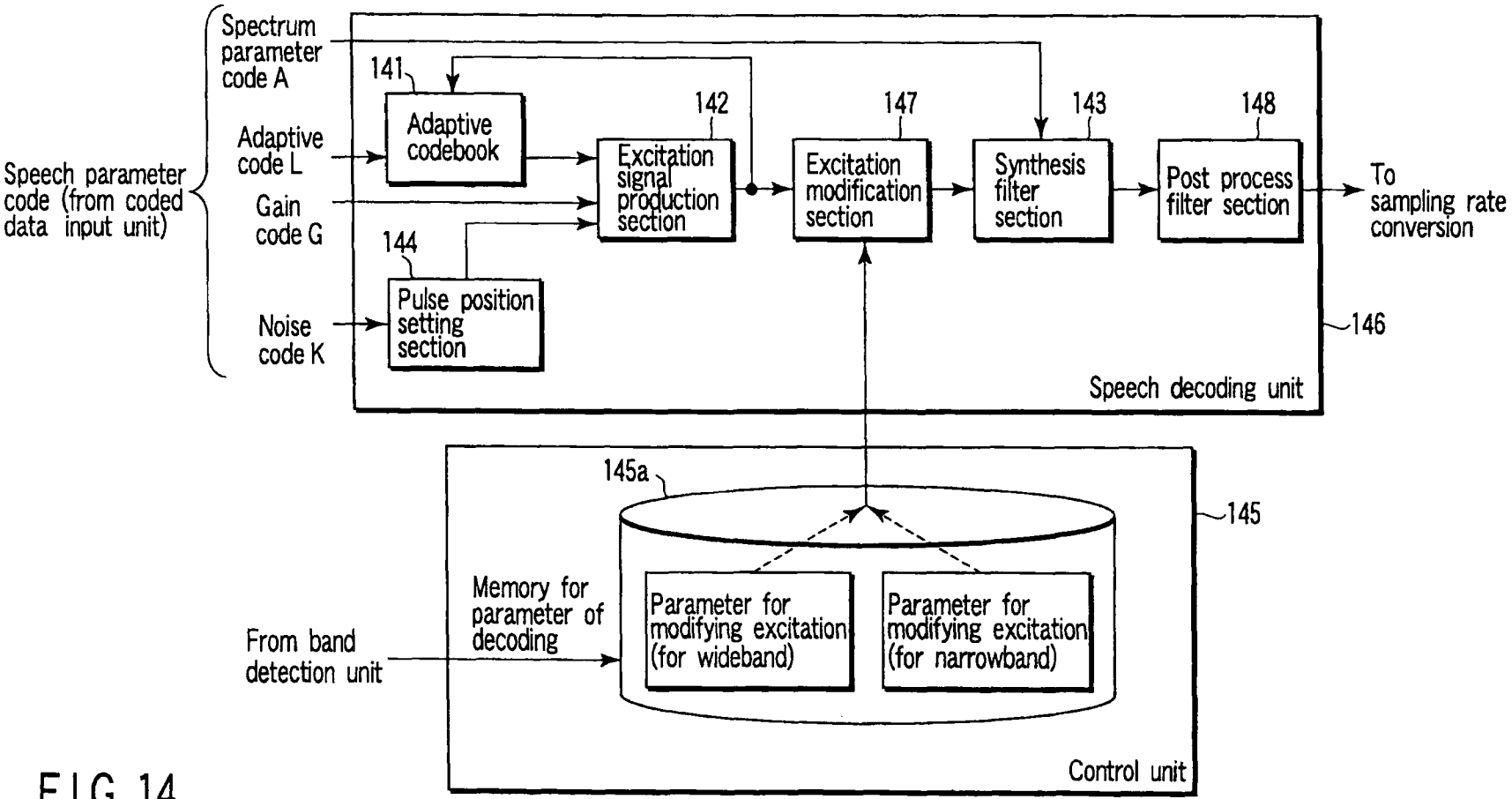
FIG. 14 is a block diagram showing a first example of the speech decoding unit and the control unit according to a fourth embodiment of the present invention.

FIG. 14 is a block diagram showing constitutions of a speech decoding unit 146, and a control unit for use in modifying an excitation signal produced in the decoding.

The constitution of the speech decoding unit 146 in FIG. 14 is characterized in that an excitation modification section 147 is disposed between an excitation signal production section 142 and a synthesis filter section 143. In the fourth embodiment, in a pulse position setting section 144, a pulse position candidate is set by a conventional method. The other constitution is the same as that of FIG. 13. Here, the excitation modification section 147 adjusts strength or presence of emphasis of pitch periodicity or formant in order to reduce a quantization noise perceptually with respect to the excitation signal produced by the excitation signal production section 142.

Moreover, in a memory 145*a* for parameters of decoding contained in the control unit 145, "parameters for modifying an excitation (for wideband)" for use in decoding a wideband speech signal, and "parameters for modifying the excitation (for narrowband)" for use in decoding a narrowband speech signal are stored in such a manner that the parameter can be selectively read. That is, the control unit 145 selectively reads "the parameter for modifying the excitation (for wideband)" or "the parameter for modifying the excitation (for narrowband)" from the contained memory 145*a* for the parameters of decoding based on identification information of the wideband/narrowband, and sends the parameter to the excitation modification section 147.

The excitation modification section 147 can set strength or presence of emphasis of pitch periodicity or formant corresponding to the wideband speech signal or the narrowband speech signal in decoding the wideband speech signal or the narrowband speech signal. As a result, the influence of quantization noise can be appropriately reduced corresponding to the wideband speech signal or the narrowband speech signal.

Concretely, in a case where it is seen by the identification information of the band that the narrowband speech signal is decoded, it is desirable that the excitation signal is modified comparatively strongly because it is predicted that the excitation signal produced by the wideband speech decoding is largely degraded as compared with a case where it is seen by the identification information of the band that the wideband speech signal is decoded.

Figure 21:
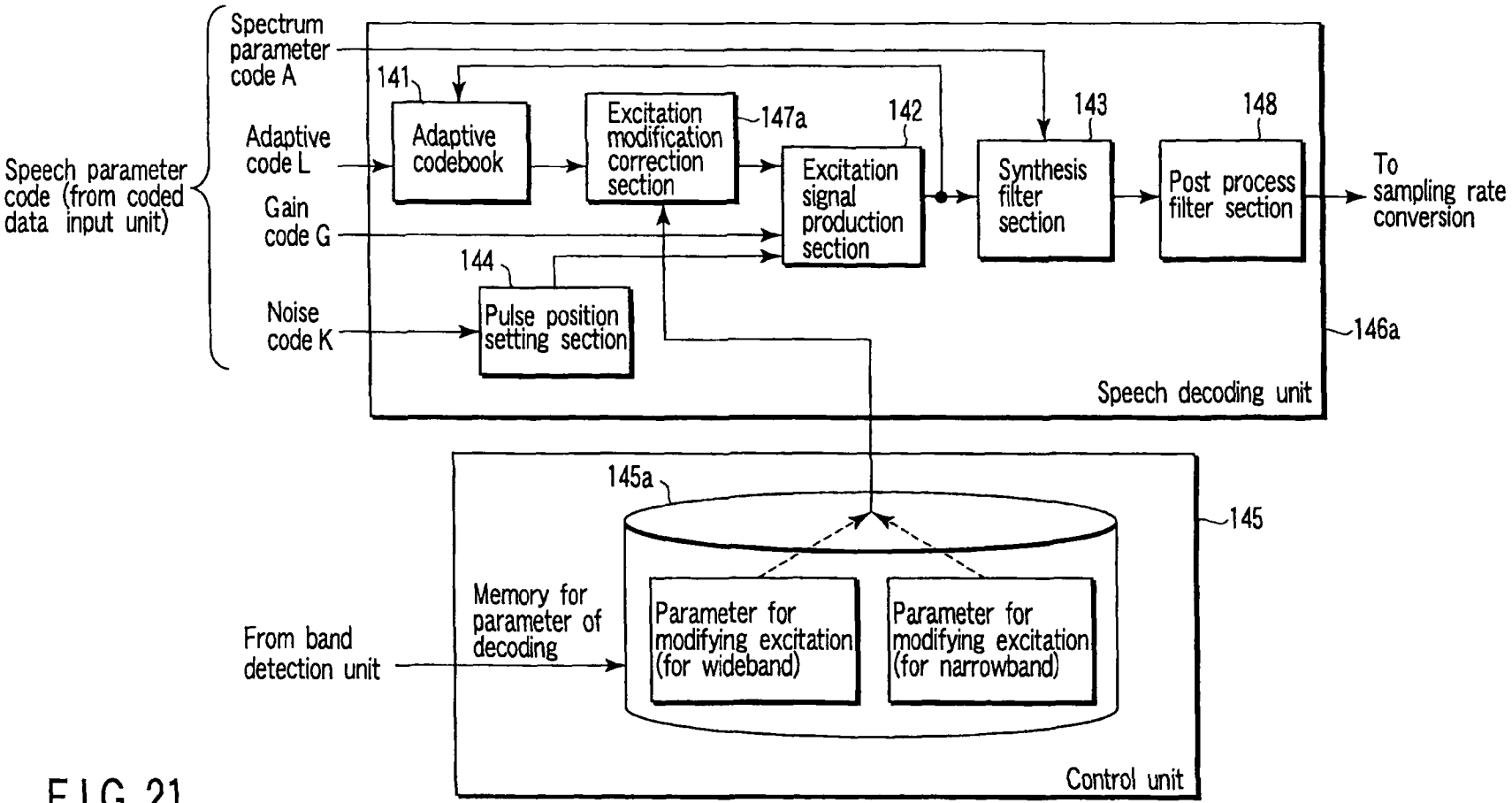
FIG. 21 is a block diagram showing a second example of the speech decoding unit and the control unit according to the fourth embodiment of the present invention.
Figure 22:
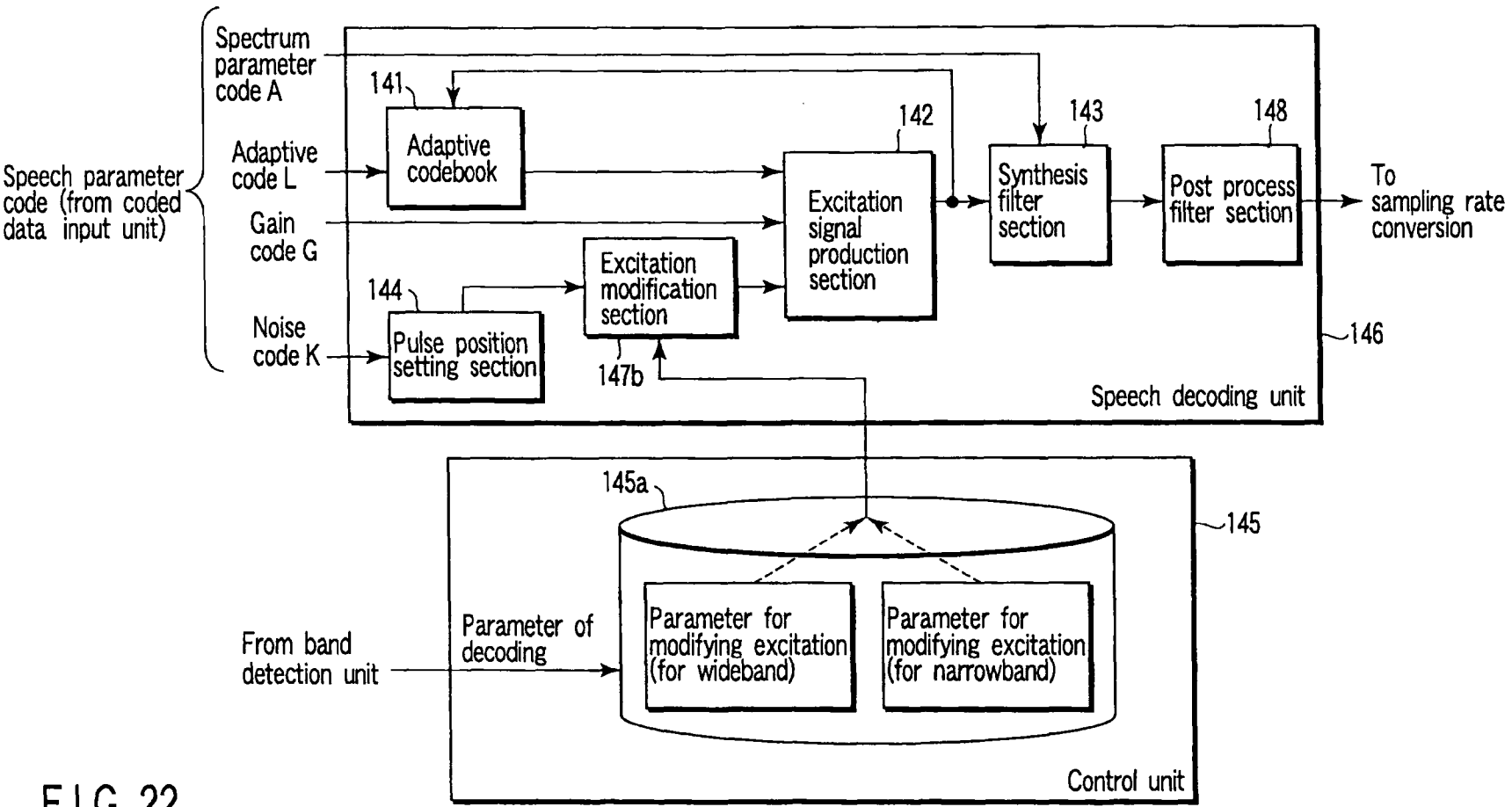
FIG. 22 is a block diagram showing a third example of the speech decoding unit and the control unit according to the fourth embodiment of the present invention.

A method of modifying the excitation signal produced in the decoding depending on whether the detected band information indicates wideband or narrowband is not limited to the constitution of FIG. 14, and a constitution shown, for example, in FIG. 21 or FIG. 22 may be used.

FIG. 21 shows a constitution in which an excitation modification section 147*a* modifies an adaptive code vector from an adaptive codebook 141, and the modified excitation signal is produced using the modified adaptive code vector. In this case, the adaptive code vector which is a base constituting the excitation signal is modified depending on whether the band information indicates wideband or narrowband. Therefore, as a result, the excitation signal is modified depending on whether the band information indicates wideband or narrowband.

Moreover, FIG. 22 shows a constitution in which an excitation modification section 147*b* modifies a noise code vector from a pulse position setting section 144, and the modified excitation signal is produced using the modified noise code vector. In this case, the noise code vector which is a base constituting the excitation signal is modified depending on whether the band information indicates wideband or narrowband. Therefore, as a result, the excitation signal is modified depending on whether the band information indicates wideband or narrowband.

In this manner, there are various realizing methods and, needless to say, any methods are included in the present invention as long as the excitation signal is modified depending on whether the band information indicates wideband or narrowband.

According to the fourth embodiment of the present invention, the speech signal can be adaptively modified in accordance with the wideband/narrowband of the speech signal to be reproduced. Therefore, the influence of quantization noise can be appropriately reduced.

Fifth Embodiment

In a fifth embodiment, a speech decoding unit is constituted in such a manner as to be capable of selecting strength or presence of emphasis of pitch periodicity or formant by a post process filter of a synthesized speech signal in accordance with distinction of wideband or narrowband obtained from identification information of a band.

Figure 15:
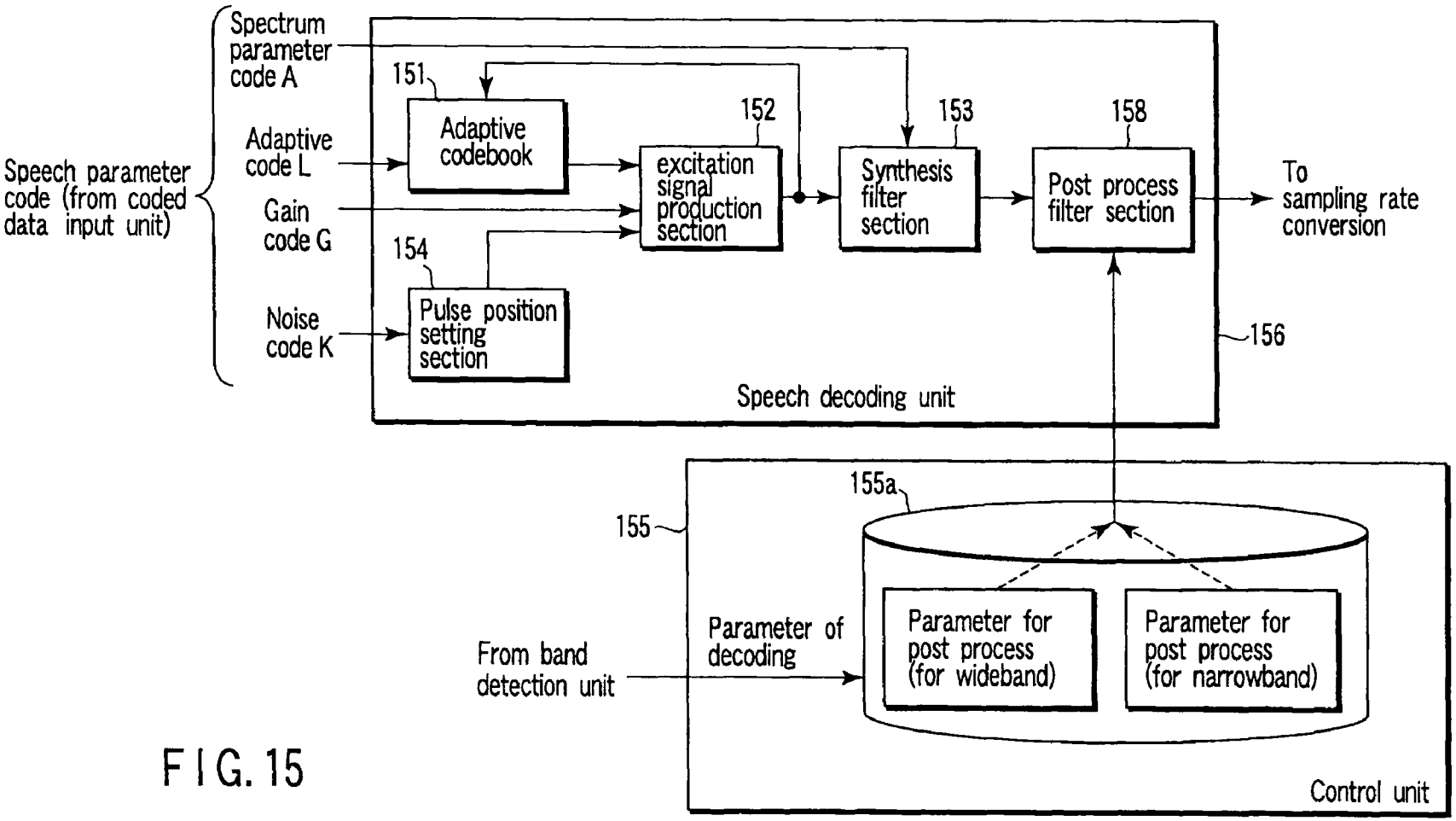
FIG. 15 is a block diagram showing the first example of the speech decoding unit and the control unit according to a fifth embodiment of the present invention.

FIG. 15 is a block diagram showing a constitution of a speech decoding unit 156, and a control unit 155 including a memory 155*a* for parameters of decoding associated with this speech decoding unit.

The speech decoding unit 156 in FIG. 15 comprises an adaptive codebook 151, an excitation signal production section 152, a synthesis filter section 153, a pulse position setting section 154, and a post process filter section 158.

The pulse position setting section 154 is the same as the pulse position setting section 144 of FIG. 14. The adaptive codebook 151, the excitation signal production section 152, and the synthesis filter section 153 are the same as the adaptive codebook 131, the excitation signal production section 132, and the synthesis filter section 133 of FIG. 13, respectively. Furthermore, in the memory 155*a* for parameters of decoding contained in the control unit 155, "parameter for a post process (for wideband)" for use in decoding a wideband speech signal, and "parameter for the post process (for narrowband)" for use in decoding a narrowband speech signal are stored in such a manner as to be selectively read. That is, the control unit 155 selectively reads "the parameter for the post process (for the wideband)" or "the parameter for the post process (for the narrowband)" from the memory 155*a* for parameter of decoding contained therein based on the identification information of the wideband/narrowband, and sends the parameter to the post process filter section 158.

The post process filter section 158 is capable of setting strength or presence of emphasis of pitch periodicity or formant in processing a wideband speech signal or a narrowband speech signal from the synthesis filter section 153. As a result, even when the decoded speech signal is the wideband speech signal or the narrowband speech signal, the influence of quantization noise can be appropriately reduced.

As a concrete example, when it is seen by the identification information of the band that the narrowband speech signal is decoded, it is predicted that the speech signal output from the synthesis filter is largely degraded in the wideband speech decoding as compared with a case where it is seen by the identification information of the band that the wideband speech signal is decoded. Therefore, the parameter for use in the post process filter is preferably controlled in such a manner as to comparatively strongly modify the speech signal.

Figure 23:
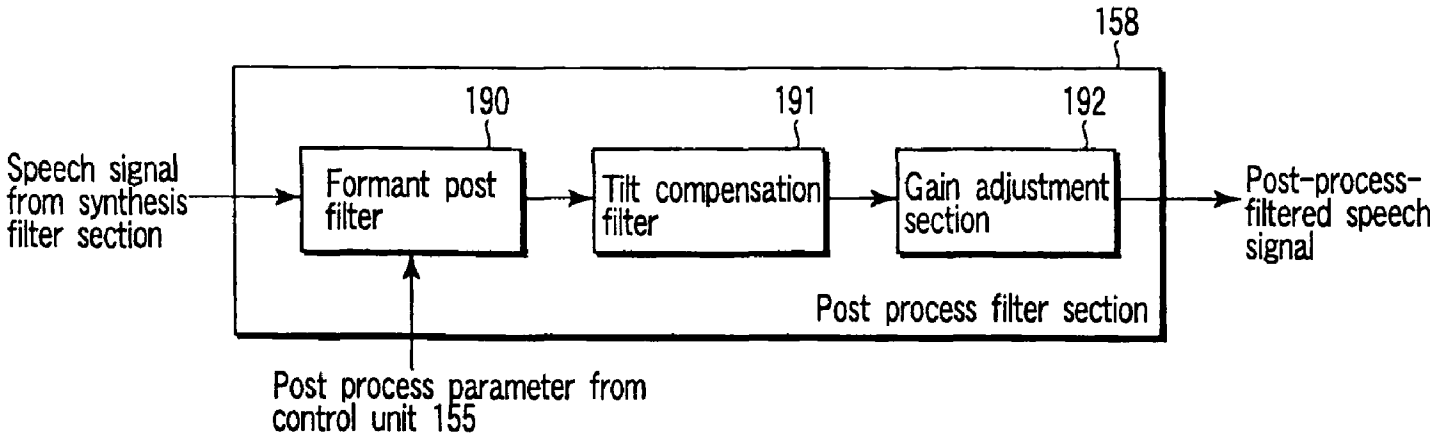
FIG. 23 is a block diagram showing a constitution example of a post-process filter unit according to a fifth embodiment of the present invention.

As a detailed example of the post process filter section 158, an adaptive post filter will be described. For example, as shown in FIG. 23, the adaptive post filter comprises a formant post filter 190, a tilt compensation filter 191, and a gain adjustment section 192, but is not limited to this constitution. The constitution of the adaptive post filter may further include a pitch emphasis filter.

As an example, a process of the adaptive post filter will be performed as follows. First, the speech signal from the synthesis filter is passed through the formant post filter 190, and an output signal is passed through the tilt compensation filter 191. Moreover, an output signal from the tilt compensation filter is input into the gain adjustment section 192 to thereby perform gain adjustment. As a result, a speech signal which is an output of the adaptive post filter is obtained. It is to be noted that a process order inside the adaptive post filter is not limited to this, and various constitutions can be adopted such as a constitution in which the speech signal from the synthesis filter is first passed through a tilt compensation filter, or a constitution in which a gain compensation process is performed in an first stage or intermediate stage of the process of the adaptive post filter.

The example of FIG. 23 shows a constitution in which a parameter for use in the formant post filter 190 is controlled by the control unit 155 in accordance with the identification information of the band to thereby control a degree of emphasis of an outline of a spectrum of a speech.

The post filter is updated for each sub-frame obtained by dividing a frame in many cases. For example, in a typical example where the speech decoding frame is 20 ms, 5 ms or 10 ms is used as a sub-frame length in many cases.

A formant post filter 190 (Hf(z)) is given, for example, by the following equation:

$$H_f(z) = \frac{\hat{A}(z/\gamma_n)}{\hat{A}(z/\gamma_d)} \tag{1}$$

where A^(z) is represented by the following equation using an LPC coefficient a^i (i=1, . . . p; p is a degree of the LPC, and is typically about 8 to 16) obtained from a spectrum parameter code A:

$$\hat{A}(z) = 1 + \sum_{i=1}^{P} \hat{\alpha}_i z^{-1}, \tag{2}$$

1/A^(z) denotes an outline (referred to also as a spectrum envelope) of the spectrum of the reproduced speech signal, and a characteristic of the formant post filter Hf(z) is determined by parameters γn and γd. Usually, the parameters γn and γd have relations of 0<γn<1 and 0<γd<1. Especially, when γn<γd is set, the formant post filter Hf(z) has a characteristic to emphasize the outline of the spectrum of the speech signal. It is possible to change a degree of emphasis of the outline of the spectrum of the speech signal in accordance with the values of γn and γd.

For example, assuming that γn=0.5, γd=0.55 are set as a first parameter set, and γn=0.5, γd=0.7 are set as a second parameter set, the formant post filter has a large degree of emphasizing (modifying) the outline of the spectrum of the speech signal in the second parameter set as compared with the first parameter set. When the parameter (set) is switched in this manner, the characteristic of the adaptive post filter can be modified (changed).

In the present invention, if the narrowband signal is detected, the parameter (set) is switched in such a manner that the degree of the emphasis (modification) by the adaptive post filter is large. If the narrowband signal is detected in the above-described example, a second parameter set (e.g., γn=0.5, γd=0.7) having a large degree of the emphasizing (modifying) of the outline of the spectrum of the speech signal is used. On the other hand, if the wideband signal is detected, a first parameter set (e.g., γn=0.5, γd=0.55) having a comparatively small degree of the emphasizing (modifying) of the outline of the spectrum of the speech signal is used.

Thus, in a case where the narrowband speech signal whose quality is easily degraded is produced by a decoding process, the outline of the spectrum can be emphasized with an appropriate strength to thereby improve the speech quality. On the other hand, since there is a small tendency toward quality degradation with respect to the wideband speech signal, the outline of the spectrum does not have to be emphasized very much. Therefore, the parameter (set) having a smaller degree of the emphasizing of the outline of the spectrum is used. In this case, since the outline of the spectrum can be appropriately emphasized depending on whether the narrowband speech or the wideband speech is produced, high-quality speech can be stably provided even at a low bit rate.

Needless to say, numeric values of the above-described first and second parameter sets are not limited to these values. For example, it is possible to use γn and γd set to an equal value, such as γn=0.5, γd=0.5, as a first parameter set for use in the post process filter for wideband. In this case, this method is substantially equal to not-emphasizing (modifying) of the outline of the spectrum. Therefore, this method is also effective as a method in which the degree of the emphasis is reduced.

The output signal from the formant post filter 190 is passed through the tilt compensation filter 191. A tilt compensation filter Ht(z) compensates for tilt of the formant post filter Hf(z), and is given as one example by the following equation:

$$H_t(z)=1-\mu z^{-1},$$

where μ=γtk1', and k1' is obtained by the following equation using an impulse response hf(n) of a filter A^(z/γn)/A^(z/γd):

$$k_1' = \frac{r_h(1)}{r_h(0)};\ r_h(i) = \sum_{j=0}^{L_h-i-1} h_f(j)h_f(j+i)$$

In the above-described example, k1' is obtained from the impulse response cut off by a length Lh (e.g., about 20), and this is not limited.

The gain adjustment section 192 inputs an output signal from the tilt compensation filter to perform gain adjustment. The gain adjustment section 192 calculates a gain value for compensating for a gain difference between a speech signal from the synthesis filter which is an input signal of the post filter, and an output signal after the process by the post filter. Moreover, the gain of the post filter itself is adjusted based on the calculation result. In this case, the gain can be adjusted in such a manner that a magnitude of the speech signal input into the post filter is substantially almost equal to that of the speech signal output from the post filter.

In the above-described example, the formant post filter is used as a modification of the speech signal using the post process filter, but this is not limited. For example, adaptation is possible even by a constitution in which a parameter associated with at least one of the pitch emphasis filter for emphasizing the pitch periodicity of the speech signal, the tilt compensation filter, and the gain adjustment process is modified depending on whether the band information indicates the wideband or the narrowband to thereby modify the speech signal.

The scope of the present invention is characterized in that a speech signal is adaptively modified depending on whether the band information indicates the wideband or the narrowband and, needless to say, the constitution of an adaptive post process in accordance with the scope is included in the present invention.

According to the fifth embodiment of the present invention, since the outline of the spectrum of the speech signal is adaptively shaped by the post process filter depending on whether detected band information of the speech signal indicates the wideband or the narrowband, there is an effect that an influence of the quantization noise included in the speech signal can be appropriately reduced.

Sixth Embodiment

In a sixth embodiment, the present invention is characterized in that a speech decoding unit 166 comprises a lower-band production unit 166*a* (which produces a speech signal on a lower-band side, and typically produces a speech signal on a lower-band side of less than or equal to about 6 kHz), and a higher-band production unit 166*b* (which produces a higher-band signal, and typically produces a speech signal of frequency band of about 6 kHz to 7 kHz on a higher-band side. Moreover, by controlling the higher-band production unit 166*b* depending on distinction of wideband or narrowband of detected band information, the higher-band signal in the speech decoding unit is modified or the production process of the higher-band signal is modified.

As a method of modifying the higher-band signal, when the detected band information indicates the narrowband, it is a gist that a modification is made in such a manner that the higher-band signal from the higher-band production unit 166*b* is not applied to the signal from the lower-band production unit 166*a*.

Each section which is a characteristic of the sixth embodiment will be described hereinafter with reference to FIG. 24.

The lower-band production unit 166*a* comprises an adaptive codebook 161, a pulse position setting section 164, an excitation signal production section 162, a synthesis filter section 163, a post process filter section 168, and a sampling-up section 169. The lower-band production unit 166*a* produces a speech signal using the adaptive codebook 161, pulse position setting section 164, excitation signal production section 162, and synthesis filter section 163. The produced speech signal is processed by the post process filter section 168, and accordingly the speech signal on the lower-band side is produced in which coding noise included in the speech signal has been shaped. Here, about 12.8 kHz is typically used as the sampling rate of the speech signal.

Next, the produced speech signal is input to the sampling-up section 169, and is sampled up at a sampling rate (typically 16 kHz) which is equal to that of the higher-band signal. The speech signal on the lower-band side, which has been sampled up at 16 kHz in this manner, is output from the lower-band production unit 166*a*, and input into the higher-band production unit 166*b*.

The higher-band production unit 166*b* comprises a higher-band signal production section 166*b*1 and a higher-band signal addition section 166*b*2. The higher-band signal production section 166*b*1 produces a synthesis filter for a higher-band, representing the shape of the spectrum of a higher-band signal using information of the synthesis filter including the outline of the spectrum shape of the speech signal on the lower-band side for use in the synthesis filter section 163. Moreover, the speech signal for the higher band, whose gain has been adjusted, is input into the produced synthesis filter, and the synthesized signal is passed through a predetermined band pass filter to thereby produce a higher-band signal. A gain of the excitation signal for the higher-band is adjusted based on energy of the speech signal on the low-band side, and tilt of the spectrum of the speech signal on the lower-band side.

The higher-band signal addition section 166*b*2 produces a signal obtained by adding the higher-band signal produced by the higher-band signal production section 166*b*1 to the speech signal on the lower-band side inputted from the lower-band production unit 166*a*. Moreover, the produced signal is input as an output from the speech decoding unit 166 into a sampling rate conversion unit 1104.

The sampling rate conversion unit 1104 has a function similar to that of the sampling rate conversion unit 114 of FIG. 11. The sampling rate conversion unit 1104 receives the speech signal output from the speech decoding unit 166. Moreover, when the band information indicates the wideband based on band information output from a control unit 165, the speech signal from the speech decoding unit is output as such to a speech output unit without performing sampling rate conversion.

On the other hand, when the band information from the control unit 165 indicates the narrowband, it is understood that the speech signal inputted into the sampling rate conversion unit 1104 from the speech decoding unit is a narrowband signal that does not have a high frequency. In this case, the sampling rate conversion unit 1104 converts the speech signal (typically 16 kHz sampling) inputted from the speech decoding unit into a low sampling rate (typically 8 kHz sampling) for the narrowband signal, and outputs the signal.

An operation of the method of the present invention will be described more concretely as follows with reference to the example of FIG. 24. When the band information input into the control unit 165 indicates the narrowband, the control unit 165 controls the higher-band production unit 166*b*, and prevents the higher-band signal from the higher-band production unit from being applied to the signal from the lower-band production unit.

As a more concrete method, in the higher-band signal production section 166*b*1, a process for producing a higher-band signal is not performed, or a produced higher-band signal is modified in such a manner as to indicate zero or a small value, and output. As another method, in the higher-band signal addition section 166*b*2, the method of outputting the signal from the lower-band production unit as it is, without adding the higher-band signal to the signal from the lower-band production unit may be used.

Figure 24:
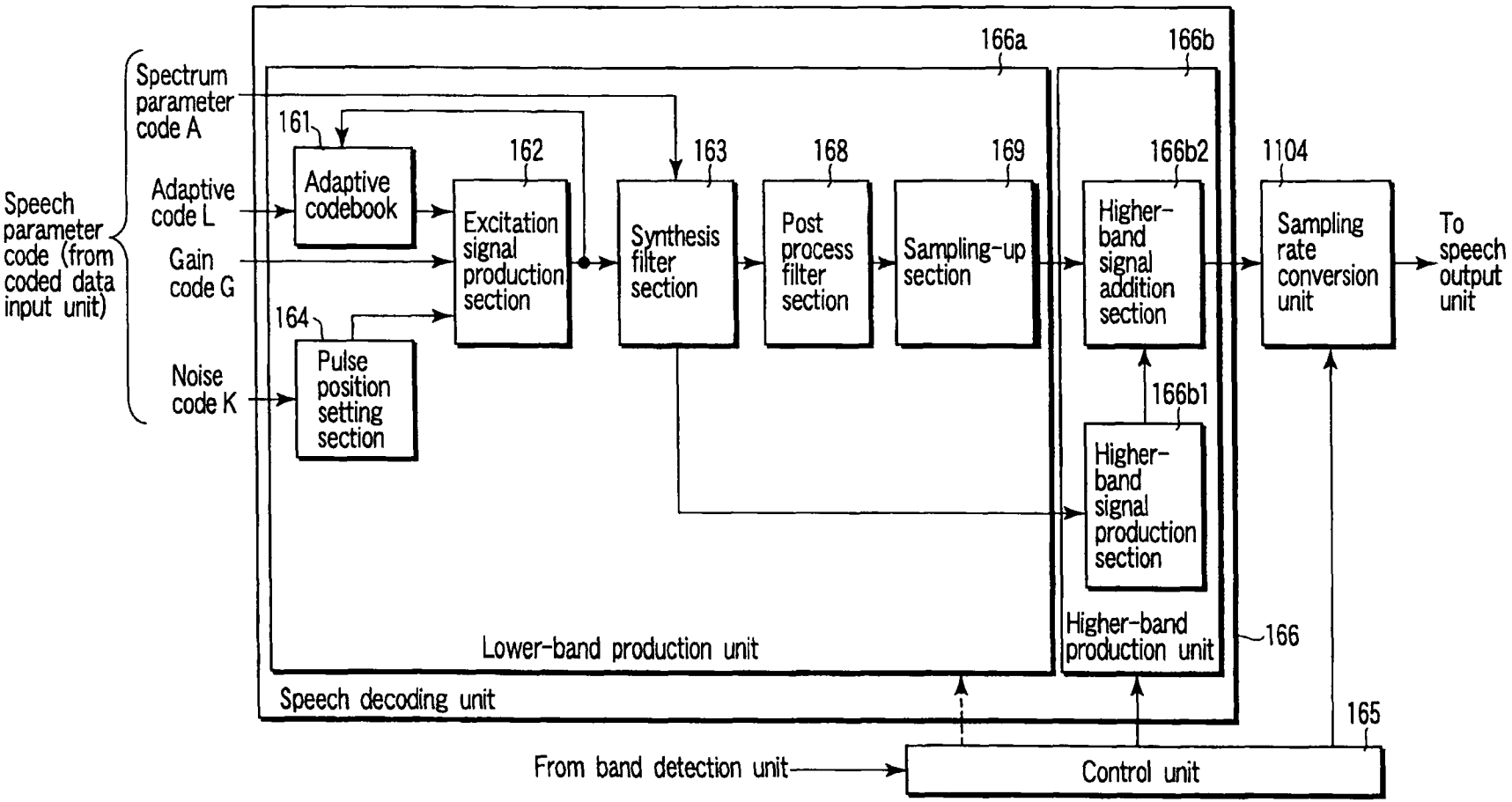
FIG. 24 is a block diagram showing a first example of the speech decoding unit and the control unit according to a sixth embodiment of the present invention.

Furthermore, needless to say, the respective inventions described in the third, fourth, and fifth embodiments may be used in the speech decoding unit on the lower-band side (the lower-band production unit 166*a* in FIG. 24) in the constitution of FIG. 24.

Figure 26:
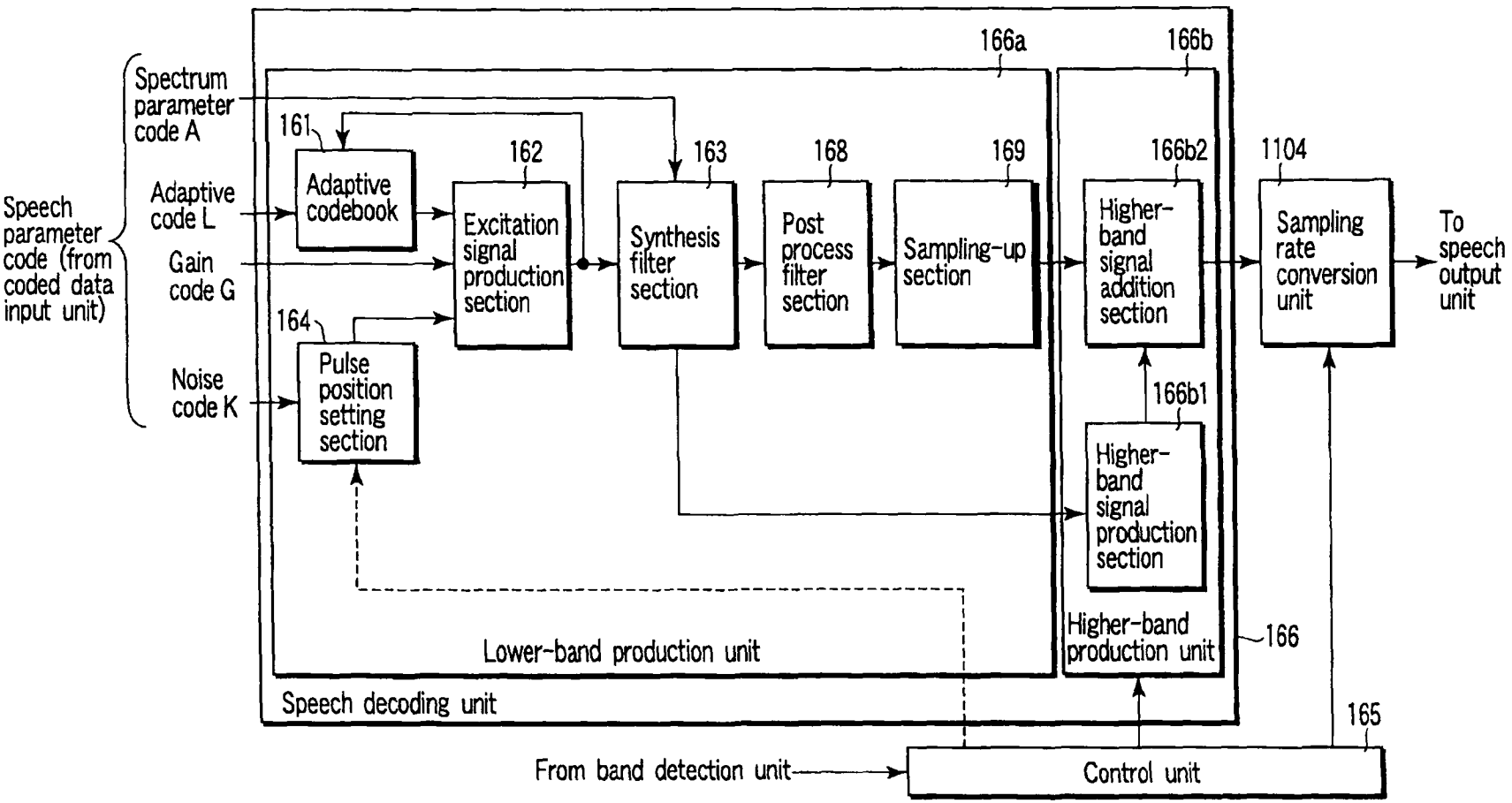
FIG. 26 is a block diagram showing a second example of the speech decoding unit and the control unit according to the sixth embodiment of the present invention.
Figure 27:
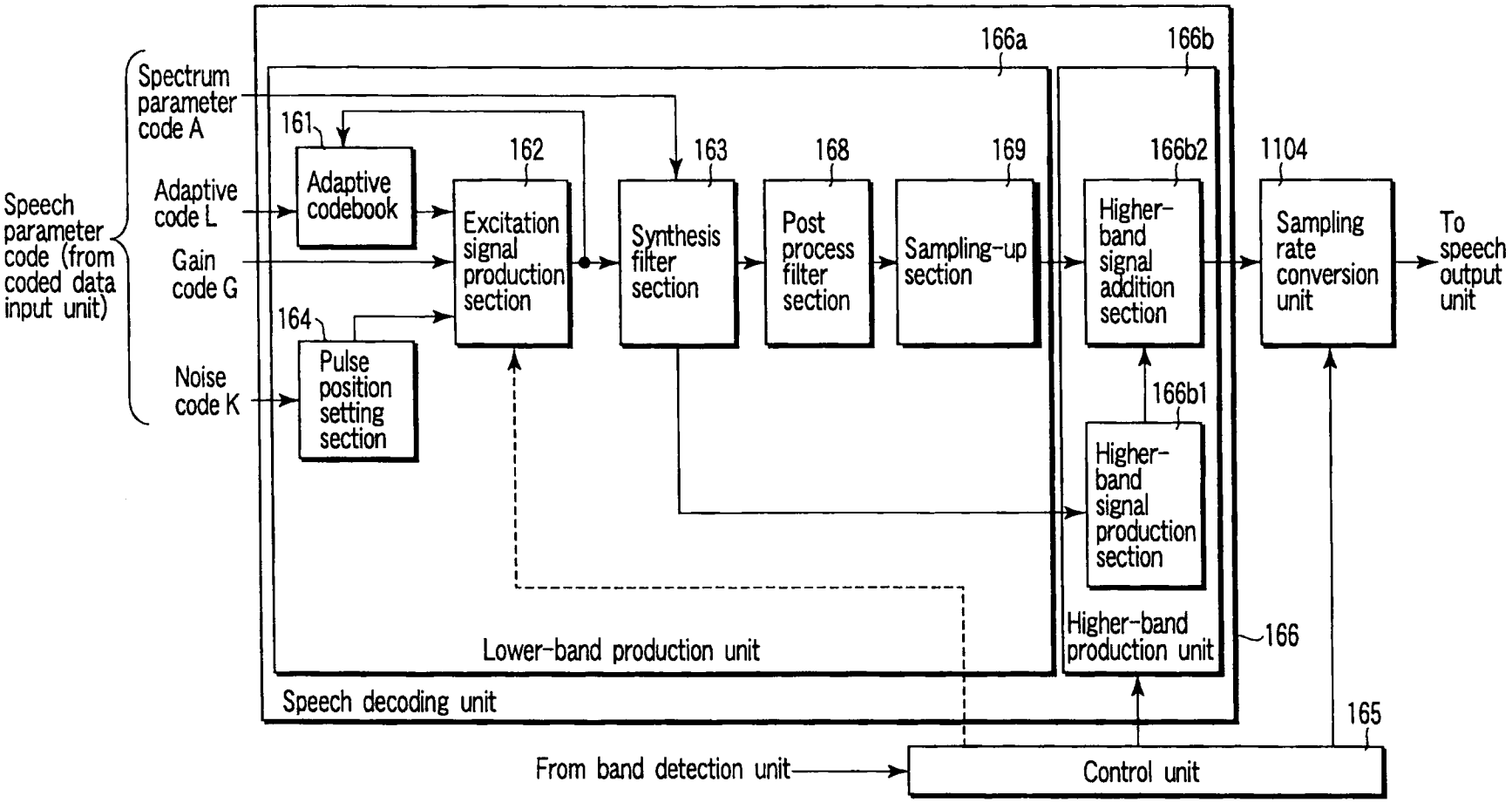
FIG. 27 is a block diagram showing a third example of the speech decoding unit and the control unit according to the sixth embodiment of the present invention.
Figure 28:
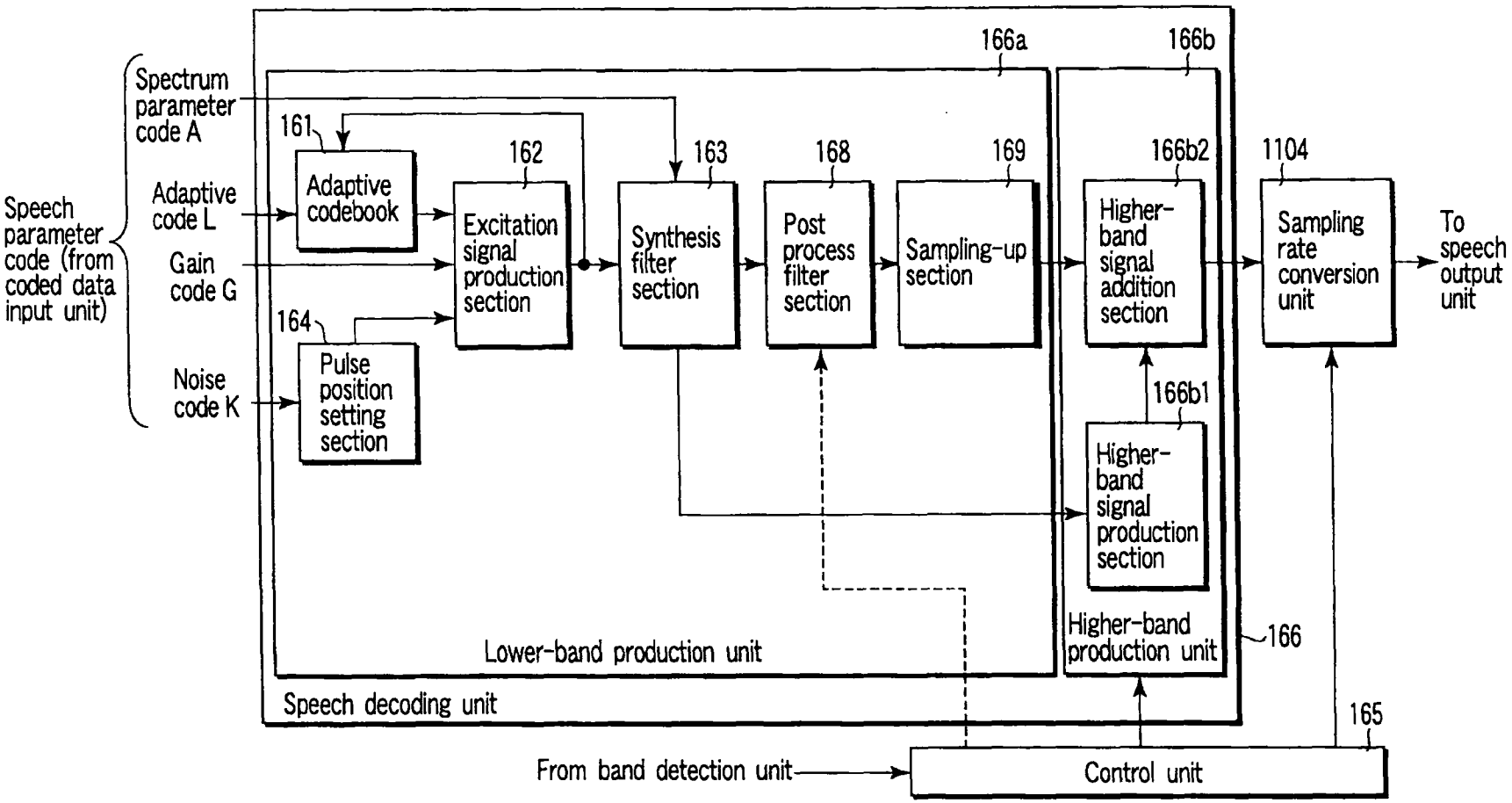
FIG. 28 is a block diagram showing a fourth example of the speech decoding unit and the control unit according to the sixth embodiment of the present invention.

That is, when the speech decoding unit on the lower-band side (the lower-band production unit 166*a* in FIG. 24) is controlled based on the detected band information, there is an effect that the speech quality of the produced narrowband speech can be improved. In this case, a control signal (shown by a dot-line arrow in FIG. 24) from the control unit 165 is constituted to be input into the lower-band unit 166*a*. An example in which the control signal (shown by the dot-line arrow) input into the lower-band unit 166*a* is shown is shown in FIG. 26 (pulse position setting section is controlled), FIG. 27 (excitation signal is controlled), and FIG. 28 (post process filter section is controlled). Since they correspond to FIG. 13 in the third embodiment, FIG. 14 in the fourth embodiment, and FIG. 15 in the fifth embodiment, detailed description is omitted.

Moreover, when the wideband speech decoding unit comprises the lower-band production unit (produce the speech signal on the lower-band side) and the higher-band production unit (produce the higher-band signal), a method may be performed in which one of the inventions described in the third, fourth, and fifth embodiments is used in the lower-band production unit, and the higher-band production unit is not controlled. Even in this case, the same effect as that of the invention described in the third, fourth, and fifth embodiments is obtained.

In this case, in a constitution example of the invention, in FIG. 24, FIG. 26, FIG. 27, and FIG. 28, there is a control signal (control with respect to the lower-band production unit) output from the control unit 165 and shown by a dot-line arrow, and there is no control signal (control with respect to the higher-band production unit) shown by a solid-line arrow.

Seventh Embodiment

A seventh embodiment of the present invention will be described hereinafter with reference to FIG. 25.

The seventh embodiment is similar to the above-described sampling rate conversion unit 114 in that a process in the sampling rate conversion unit is controlled based on band information. However, the seventh embodiment of the present invention is characterized in a sampling-down process in the sampling rate conversion unit. In this case, the band information for use from the band detection unit is used.

In a conventional sampling-down process, in order to prevent frequency folding (aliasing) by the sampling-down, it has heretofore been necessary to limit the band of the signal using the band limiting filter before performing the sampling-down. Therefore, problems occur that the output signal is delayed due to delay brought by the band limiting filter, and a calculation amount increases by the process of the band limiting filter. To limit the band with the filter with high performance, a high-degree band limiting filter is required, and a problem also occurs that the delay or the calculation amount of the filter output increases.

On the other hand, in the seventh embodiment of the present invention, the sampling rate conversion unit may be controlled based on the band information to perform the sampling-down. Therefore, when the band information indicates the narrowband, it is possible to sample down the signal by thinning-out without performing band limiting filter by utilizing the fact that it is guaranteed that the speech signal input into the sampling rate conversion unit is a narrowband signal. As a result, since the band limiting filter is not required, there is an effect that the delay of the output signal by the sampling-down process does not occur. Since the band limiting filter is not used, there is an effect that the calculation amount can be reduced. Additionally, after confirming that the band of the speech signal input into the sampling rate conversion unit is limited to the narrowband based on the detected band information, the signals are sampled down by thinning-out. Therefore, there is an effect that the influence of the frequency folding (aliasing) by the sampling-down can be much reduced.

Here, an operation of the seventh embodiment will be described with reference to FIG. 25.

Figure 25:
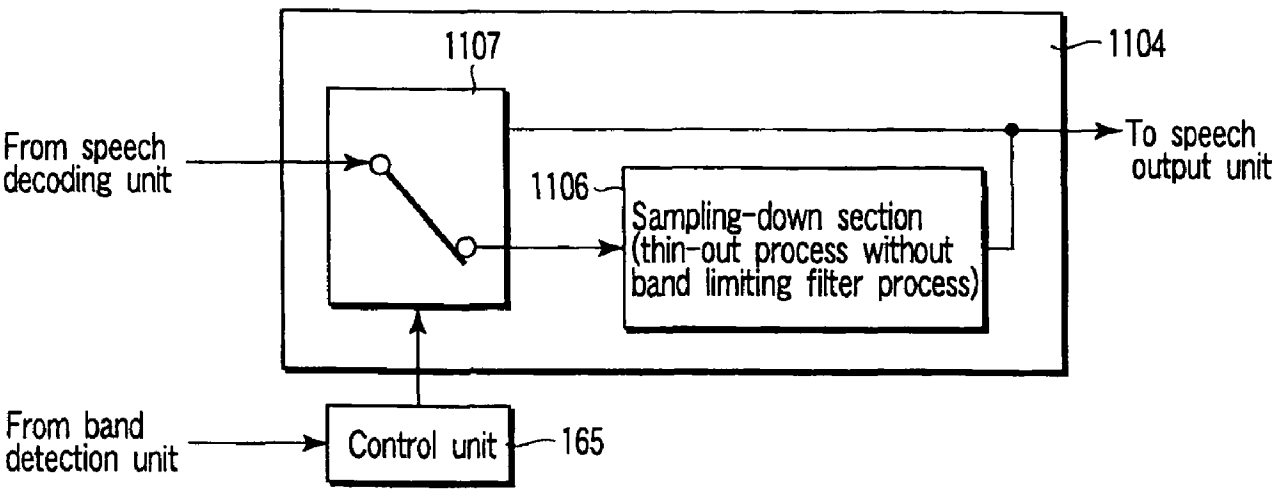
FIG. 25 is a block diagram showing a constitution of a sampling rate conversion unit and control unit according to the seventh embodiment of the present invention.

FIG. 25 shows a constitution of the control unit 165 and the sampling rate conversion unit 1104. The band information from the band detection unit is input into the control unit 165. The band information indicates that the speech signal (typically the speech signal of 16 kHz sampling) produced by the decoding unit is a narrowband signal or a wideband signal.

The band information obtained from the identification information of the band in the band detection unit is used. As one example, as shown in FIG. 20, what was transmitted as side information from a transmission side is used for the identification information of the band apart from the coded data, but it is not limited to this. For example, a constitution can be used in which the identification information of the band is incorporated in a part of the coded data, sent, and used. The identification information of the band, sent as data attached to the coded data, may be used.

Alternatively, in another method as described above, as shown in FIG. 19, the identification information of the band may be obtained based on a signal (e.g., a speech signal, an excitation signal, etc.) reproduced in the speech decoding unit or may be obtained based on a spectrum parameter representing an outline of spectrum of the speech signal which are reproduced in the speech decoding unit.

When the band information input into the control unit 165 indicates narrowband, the control unit 165 controls a switching unit 1107, and connects a switch in the switching unit to a side of a sampling-down unit 1106. Accordingly, the speech signal input into the sampling rate conversion unit 1104 is input into the sampling-down unit 1106.

The sampling-down unit 1106 thins out an input speech signal (typically a speech signal of 16 kHz sampling) to produce a sampled-down speech signal (typically a speech signal of 8 kHz sampling), and the signal is output to a speech output unit. At this time, in a thin-out process of the signal in the sampling-down unit 1106, the signal is simply thinned out without using a band limiting filter process.

For example, when the speech signal of 16 kHz sampling is sampled down at 8 kH in the sampling-down unit 1106, the input speech signal of 16 kHz sampling is regularly thinned out at a ratio of 2:1, and accordingly the speech signal of 8 kHz sampling can be produced. In other words, an odd-number sample of the speech signal of 16 kHz sampling, or an even-number sample only is used as such, and output as the speech signal of 8 kHz sampling.

On the other hand, when the band information input into the control unit 165 indicates wideband, the control unit 165 controls the switch of the switching unit 1107 so that the speech signal (typically the speech signal of 16 kHz sampling) input into the sampling rate conversion unit 1104 is outputted to the speech output unit as it is.

Figure 18:
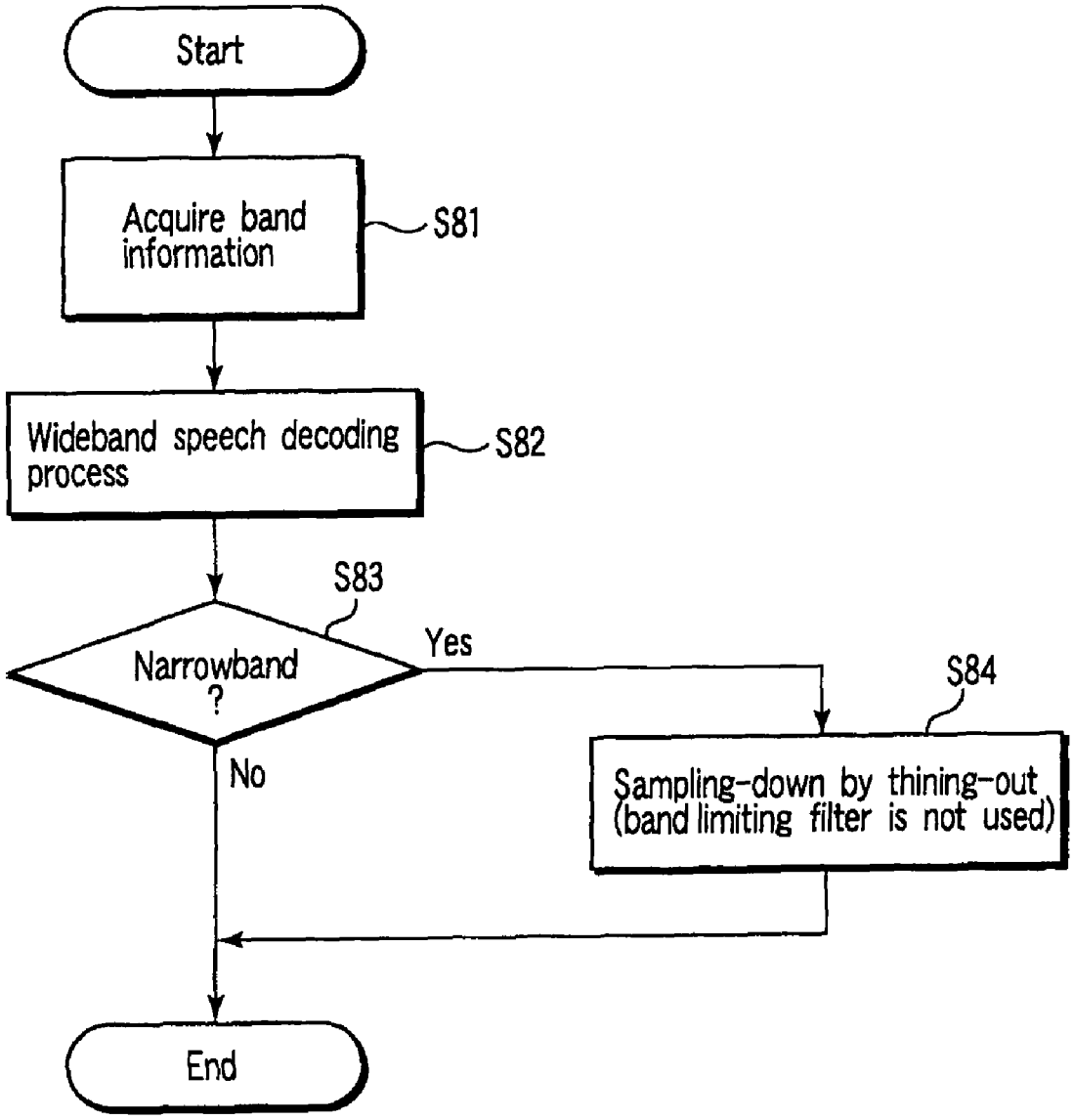
FIG. 18 is a flowchart showing the procedure and contents of the speech decoding process according to the seventh embodiment of the present invention.

FIG. 18 shows a process example of the present invention according to the seventh embodiment in a flowchart.

In step S81, band information is acquired. Next, in step S82, a wideband speech decoding process is performed. Before/after this step, it is judged in step S83 whether or not the band information indicates narrowband. At this time, if it is judged that narrowband is indicated, in step S84, a speech signal produced by a wideband speech decoding process is thinned out and sampled down without using any band limiting filter to thereby produce and output the signal. On the other hand, if it is judged in step S83 that narrowband is not indicated, the speech signal produced by the wideband speech decoding process is outputted as it is.

It is to be noted that the seventh embodiment can be used together with the respective methods described above in the third, fourth, fifth, and sixth embodiments. That is, the methods described in the respective embodiments can be used alone, and a plurality of methods may be combined.

Figure 17:
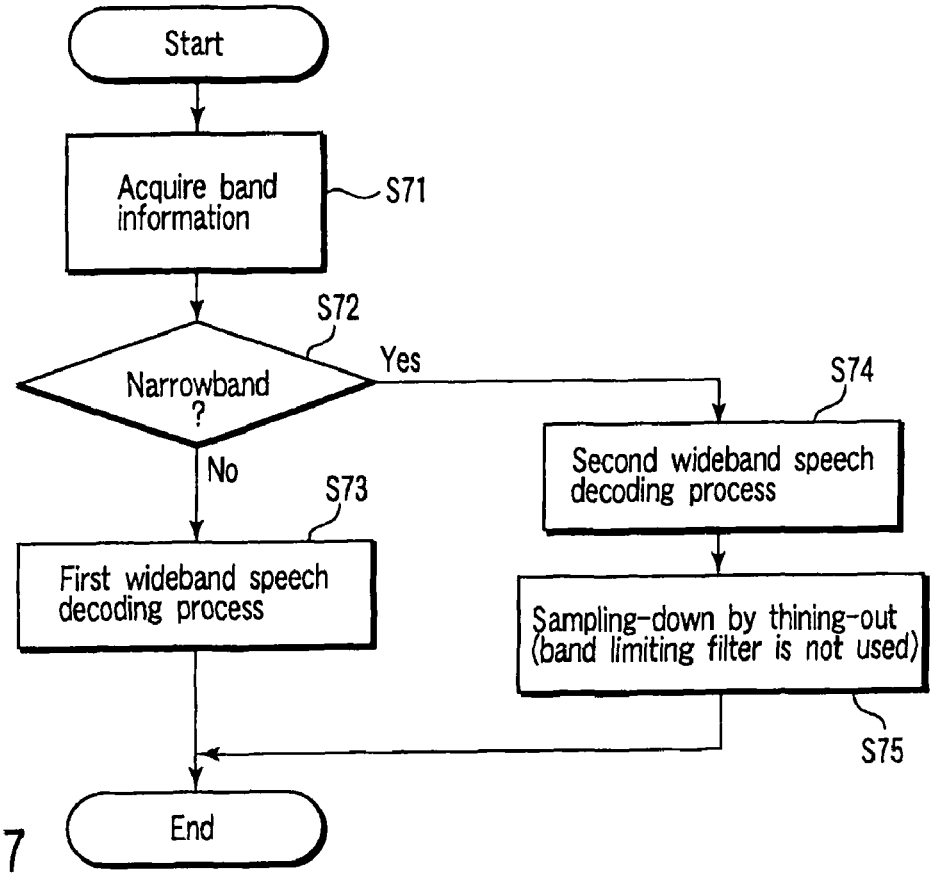
FIG. 17 is a flowchart showing the process procedure and contents in a case where a speech decoding process according to the third embodiment of the present invention is used together with that according to a seventh embodiment.

FIG. 17 shows a process example in which the method according to the seventh embodiment is used together with the method according to the third embodiment in a flowchart. In step S71, band information is acquired. Next, it is judged in step S72 whether or not the band information indicates narrowband. At this time, when it is judged that the information does not indicate narrowband, a first wideband speech decoding process (usual wideband speech decoding process using parameters for wideband) is performed in step S73.

On the other hand, when it is judged in the step S72 that the band information indicates narrowband, in step S74 a second wideband speech decoding process (wideband speech decoding process in which a parameter has been modified for narrowband) is performed in step S74. Moreover, with respect to the speech signal produced by this process, in step S75, a sampled-down speech signal is produced and outputted by a thin-out process without using any band limiting filter.

When the method in the seventh embodiment is combined with that in the sixth embodiment for use, the method becomes more effective. That is, by the use of the method in the sixth embodiment, when it is seen based on the detected band information that the speech signal to be produced by the decoding unit is the narrowband signal, the control unit controls the speech signal output from the speech decoding unit 166 in such a manner that the signal is not mixed with a higher-band signal (the higher-band signal is not completely zero even in a case where the narrowband speech signal is produced) from the higher-band production unit 166*b*. Therefore, the narrowband speech signal including further less higher-band signal components can be produced as an output of the decoding unit. Since this narrowband speech signal is input to the sampling rate conversion unit 1104, frequency folding (aliasing) generated when thinning out and sampling down the signal without performing a band limiting filter process is reduced more than that of a case where the method in the seventh embodiment is used alone, and accordingly there is an effect that the speech quality is improved.

What is claimed is:

1. A wideband speech coding apparatus, comprising:

a wideband speech coding unit configured to code an input speech signal at a bit rate which is set in advance in accordance with a wideband speech signal;

an identification unit configured to identify whether the input speech signal is a wideband speech signal or a narrowband speech signal;

a control unit configured to cause the wideband speech coding unit to code the input speech signal, when the identification unit identifies that the input speech signal is the wideband speech signal, and to cause the wideband speech coding unit to raise the bit rate to code the input speech signal, when the identification unit identifies that the input speech signal is the narrowband speech signal; and an output unit to output the input speech signal coded by the wideband speech coding unit.

2. The wideband coding apparatus according to claim 1, further comprising a detection unit for detecting speech activity of the input speech signal, wherein the control unit performs a control for causing the coding unit to code the input speech signal, only when the identification unit identifies that the input speech signal is the narrowband speech signal, and the detection unit detects that the speech activity of the input speech signal is higher than a predetermined level.

3. A wideband speech coding apparatus, comprising:

a wideband speech coding unit configured to code an input speech signal at a bit rate which is set in advance in accordance with a wideband speech signal;

an identification unit configured to identify whether a sampling rate of the input speech signal is a first sampling rate to be applied to the wideband speech signal or a second sampling rate to be applied to the narrowband speech signal;

a control unit configured to cause the wideband speech coding unit to lower the bit rate to code the input speech signal, when the identification unit identifies that the sampling rate of the input speech signal is the first sampling rate, and to cause the wideband speech coding unit to raise the bit rate to code the input speech signal, when the identification unit identifies that the sampling rate of the input speech signal is the second sampling rate; and an output unit to output a result of coding by the wideband speech coding unit.

4. A wideband speech coding apparatus which causes an input speech signal to be represented by spectrum parameters and an excitation signal, and codes the spectrum parameters and the excitation signal, the wideband speech coding apparatus comprising:

a spectrum parameter coding unit configured to extract the spectrum parameters from the input speech signal, and coding the extracted spectrum parameters;

an identification unit configured to identify whether the input speech signal is a wideband speech signal or a narrowband speech signal;

a control unit configured to set a spectrum parameter degree in the spectrum parameter coding unit, when the identification unit identifies that the input speech signal is the wideband speech signal, and to lower the spectrum parameter degree in the spectrum parameter coding unit, when the identification unit identifies that the input signal is the narrowband speech signal;

a converter configured to convert a sampling rate of the input speech signal to a predetermined sampling rate for wideband speech coding; and an output unit to output a result of coding by the spectrum parameter coding unit.

5. A wideband speech coding apparatus which causes an input speech signal to be represented by spectrum parameters and an excitation signal, and codes the spectrum parameters and the excitation signal, the wideband speech coding apparatus comprising:

a spectrum parameter coding unit configured to extract the spectrum parameters from the input speech signal, and coding the extracted spectrum parameters;

an identification unit configured to identify whether a sampling rate of the input speech signal is a first sampling rate to be applied to a wideband speech signal or a second sampling rate to be applied to a narrowband speech signal;

a control unit configured to set a spectrum parameter degree in the spectrum parameter coding unit, when the identification unit identifies that the sampling rate of the input speech signal is the first sampling rate, and to lower the spectrum parameter degree in the spectrum parameter coding unit, when the identification unit identifies that the sampling rate of the input signal is the second sampling rate;

a converter configured to convert the sampling rate of the input speech signal to a predetermined sampling rate for wideband speech coding; and an output unit to output a result of coding by the spectrum parameter coding unit.

6. A wideband speech coding method of causing an input speech signal to be represented by spectrum parameters and an excitation signal, and coding the spectrum parameters and the excitation signal, the wideband speech coding method comprising:

a process of identifying whether the input speech signal is a wideband speech signal or a narrowband speech signal;

a process of coding the spectrum parameter with a spectrum parameter degree which is set in advance in accordance with the wideband speech signal, when it is identified that the input speech signal is the wideband speech signal;

a process of lowering, when it is identified that the input speech signal is the narrowband speech signal, the spectrum parameter degree and then coding the spectrum parameters with the lowered spectrum parameter degree;

a process of converting a sampling rate of the input speech signal to a predetermined sampling rate for wideband speech coding; and a process of outputting a result of coding in the coding process and the lowering and coding process which is executed.

7. A wideband speech coding method of causing an input speech signal to be represented by spectrum parameters and an excitation signal, and coding the spectrum parameters and the excitation signal, the wideband speech coding method comprising:

a process of identifying whether a sampling rate of the input speech signal is a first sampling rate to be applied to a wideband speech signal or a second sampling rate to be applied to a narrowband speech signal;

a process of coding the spectrum parameters with a spectrum parameter degree which is set in advance in accordance with the first sampling rate, when it is identified that the sampling rate of the input speech signal is the first sampling rate;

a process of lowering, when it is identified that the sampling rate of the input speech signal is the second sampling rate, the spectrum parameter degree and then coding the spectrum parameters with the lowered spectrum parameter degree;

a process of converting the sampling rate of the input speech signal to a predetermined sampling rate for wideband speech coding; and a process of outputting a result of coding in the coding process and the lowering and coding process which is executed.

8. The wideband coding apparatus according to claim 3, further comprising a detection unit for detecting speech activity of the input speech signal, wherein the control unit performs a control for causing the coding unit to code the input speech signal, only when the identification unit identifies that the input speech signal is the narrowband speech signal, and the detection unit detects that the speech activity of the input speech signal is higher than a predetermined level.

9. A wideband speech coding method comprising:

a process of coding an input speech signal at a bit rate which is set in advance in accordance with a wideband speech signal;

a process of identifying whether the input speech signal is the wideband speech signal or a narrowband speech signal;

a process of lowering the bit rate and coding the input speech signal at the lowered bit rate, when it is identified that the input speech signal is the wideband speech signal;

a process of raising the bit rate and coding the input speech signal at the raised bit rate, when it is identified that the input speech signal is the narrowband speech signal; and a process of outputting a result of coding in the coding process.

10. The wideband coding method according to claim 9, further comprising:

a process of detecting activity of the input speech signal; and a process of coding the input speech signal at the second bit rate, only when it is identified that the input speech signal is the narrowband speech signal, and it is also identified based on the process of detecting the activity of the input speech signal that speech activity of the input speech signal is higher than a predetermined level.

11. A wideband speech coding method comprising:

a process of coding an input speech signal at a bit rate which is set in advance in accordance with a wideband speech signal;

a process of identifying whether a sampling rate of the input speech signal is a first sampling rate to be applied to the wideband speech signal or a second sampling rate to be applied to a narrowband speech signal;

a process of lowering the bit rate and coding the input speech signal at the lowered bit rate, when it is identified that the sampling rate of the input speech signal is the first sampling rate;

a process of raising the bit rate and coding the input speech signal at the raised bit rate, when it is identified that the sampling rate of the input speech signal is the second sampling rate; and a process of outputting a result of coding in the coding process.

12. The wideband coding method according to claim 11, further comprising:

a process of detecting activity of the input speech signal; and a process of coding the input speech signal at the second bit rate, only when it is identified that the input speech signal is the narrowband speech signal, and it is also identified based on the process of detecting the activity of the input speech signal that speech activity of the input speech signal is higher than a predetermined level.

* * * * *